US007144285B1

(12) United States Patent
Hendricks

(10) Patent No.: US 7,144,285 B1
(45) Date of Patent: Dec. 5, 2006

(54) HYDROFOIL SURFING BOARD

(76) Inventor: Tareah John Hendricks, 840 Bonita Dr., Encinitas, CA (US) 92024-3803

( * ) Notice: Subject to any disclaimer, the term of this patent is extended or adjusted under 35 U.S.C. 154(b) by 1 day.

(21) Appl. No.: 10/891,280

(22) Filed: Jul. 14, 2004

Related U.S. Application Data

(60) Provisional application No. 60/487,137, filed on Jul. 15, 2003.

(51) Int. Cl.
*B63B 35/79* (2006.01)
*B63B 1/24* (2006.01)
*B63B 1/28* (2006.01)

(52) U.S. Cl. ..... 441/74; 441/79; 114/274; 114/280

(58) Field of Classification Search ..... 114/39.12, 114/39.13, 39.15, 274, 280–282; 441/65, 441/68, 74, 77, 79
See application file for complete search history.

(56) References Cited

U.S. PATENT DOCUMENTS 2,815,518 A * 12/1957 Kuehn ..... 441/65
2,931,332 A * 4/1960 Hebrank ..... 114/55.54
3,121,890 A * 2/1964 Rumsey, Jr. ..... 441/70
3,182,341 A * 5/1965 Rieffie ..... 441/70
3,747,138 A * 7/1973 Morgan ..... 441/74
4,508,046 A * 4/1985 Coulter et al. ..... 114/39.15
5,062,378 A * 11/1991 Bateman ..... 114/274
5,309,859 A * 5/1994 Miller ..... 114/274
5,471,942 A * 12/1995 Miller et al. ..... 114/274

FOREIGN PATENT DOCUMENTS

DE 3044234 A * 6/1982
DE 3130554 A * 3/1983

* cited by examiner

*Primary Examiner*—Ajay Vasudeva

(57) ABSTRACT

A wave riding surfing board with a pair of transversely oriented hydrofoils, each attached to respective front and rear struts, for supporting a surfer in a prone or kneeling position. In operation, the front canard hydrofoil is arranged for piercing the surface of the water and partially supporting the weight of the rider and the board, while the fully submerged rear hydrofoil is arranged for supporting the remaining 90–100 percent of the weight. The rigging angle of the front canard hydrofoil can be adjusted. The surfing board can be maneuvered by banking the board. In a preferred embodiment, a pair of control handles and a control mechanism give rider a control over the front canard hydrofoil and the flap surfaces on the trailing edge of the rear strut to enable precision maneuvering.

21 Claims, 13 Drawing Sheets

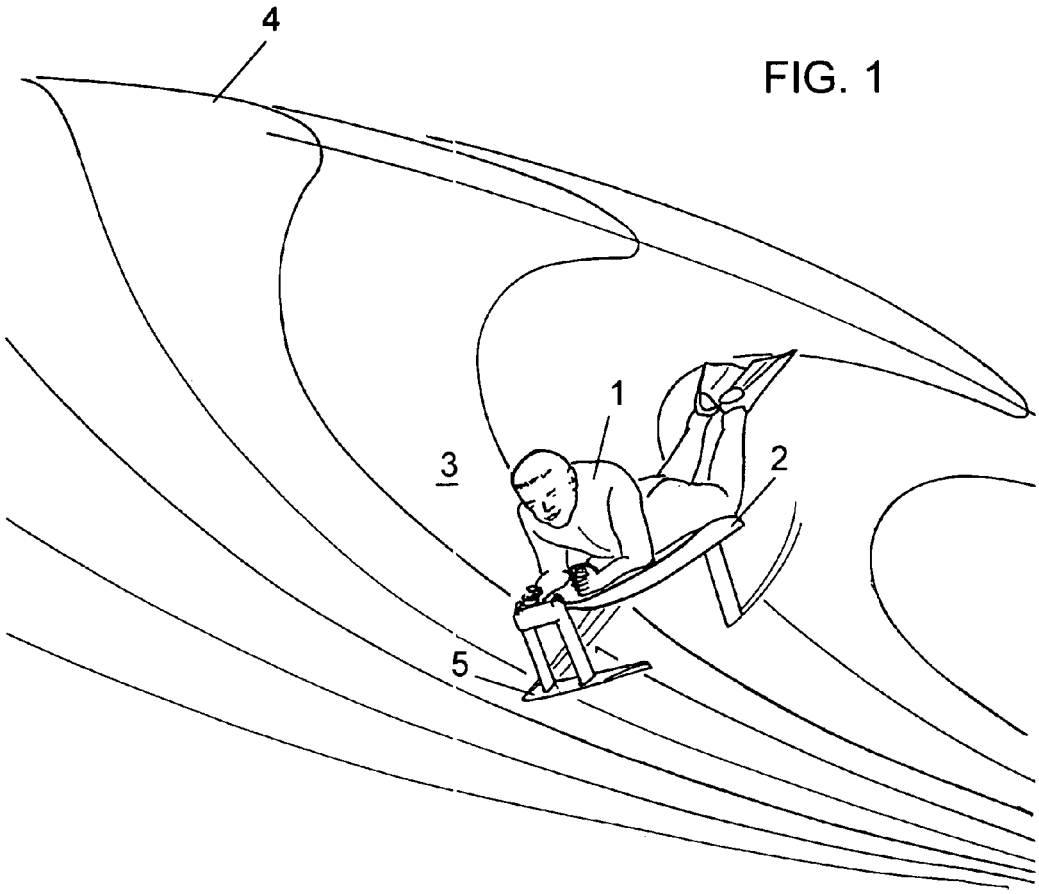
FIG. 1
FIG. 2
(Prior Art)
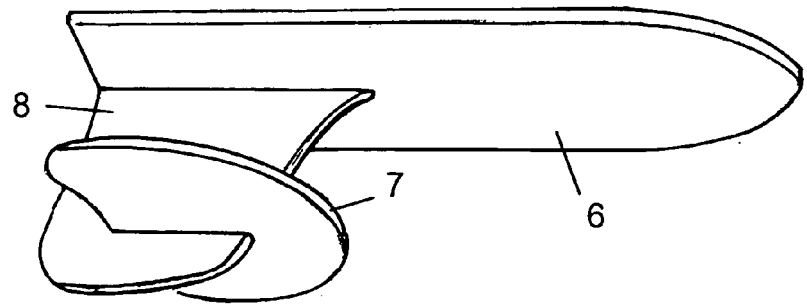

HYDROFOIL SURFING BOARD

Priority is claimed via Provisional Patent Application No. 60/487,137. Filing date: Jul. 15, 2003.

CROSS REFERENCE TO RELATED APPLICATIONS

Not Applicable

FEDERALLY SPONSORED RESEARCH OR DEVELOPMENT

Not Applicable

BACKGROUND OF THE INVENTION

The present invention relates to an improvement in wave-riding vehicles. In particular, the invention relates to a small wave-riding vehicle, ridden prone or kneeling, that incorporates a pair of hydrofoils extending below the hull and transversely to the longitudinal axis of the hull, and which support the hull and the rider above the water while traversing across the face of a breaking wave.

FIG. 1 illustrates a surfer (1) on a board (2) traveling laterally across the face (3) of a breaking wave as the wave moves into shoal water. Not all waves are suitable for surfing. If the wave breaks faster than the surfer can keep up, the rider will not be able to successfully complete the ride. At intermediate speeds of progression of the breaking crest the skilled rider will commonly incorporate a variety of maneuvers into the ride while still remaining ahead of the curl. Thus the speed potential of the surfboard, in combination with the rider's skill, determines the spectrum of breaking waves that can be successfully ridden to completion. Similarly, the response and maneuverability of a surfboard, and its ability to maintain speed while executing a maneuver, influences the type and number of maneuvers that the surfer is able to execute on those waves.

While the United States Patent Office, defines a "surfboard" (Class 441/65/74) as a "Device comprising an elongated member of a width comparable to the shoulder width of a user adapted to be propelled by a wave and capable of supporting the user.", the surfing community normally subdivides this class into a number of types according to how they are ridden. Largely because of ergonomic factors, these types can also be arranged in terms of the average lengths of the boards: "longboard" (9 feet or more in length, ridden standing), "shortboard" (shorter than 9 feet, ridden standing), "kneeboard" (ridden kneeling"), and "paipo board" and "bodyboard" (ridden prone). In fact, "paipo" is a Hawaiian word meaning "short" or "small. In the subsequent discussion, I will use the term "surfboard" to refer to a wave-riding board in which the rider is in the standing position. The terms "board" and "craft" will be used for the collective set of board types under the Patent Office classification. A "rider" or "surfer" refers to the person riding any board.

Wave-riding boards are controlled by the rider shifting mass fore-and-aft, and from side-to-side. The ability to quickly shift mass in these two directions depends to a considerable degree on the riding position. Stand-up surfers have the greatest mobility and weight-shifting capability in fore-and-aft direction. But motions in the side-to-side direction are considerably restricted by the relatively short distance between the heel and the toe (since all the forces exerted by the surfer on the board must lie within the area bounded by the heels and toes of the surfers two feet, or the surfer will fall). Conversely, a paipo or bodyboard rider's capability for rapid weight shifts fore-and-aft is considerably more restricted than for a stand-up surfer, but the rider's capability of shifting weight from side-to-side is increased. These differences affect the maneuvers than can be performed among these board types (e.g. "toes on the nose" vs. "el rollos" vs. aerials, etc.), the details of how they are performed, and the design of the craft.

Numerical simulations, calculations, and observations of the hydrodynamics of boards with planing hulls ("conventional boards") and hydrofoil boards ("foilboards") supported by one, or more, hydrofoils ("foils") when traversing across the face of a wave indicate that a well-designed foilboard can have superior speed and maneuvering performance when compared with a state-of-the-art conventional board. Nevertheless only a small number of foilboard designs exist in the prior art: G. Miller (Kuhns and Shor, 1993); U.S. Pat. No. 3,747,138 (Morgan, 1973); U.S. Pat. No. 5,062,378 (Bateman, 1991); Lum (Miyake, 1998); Hamilton, Randle, Lickle, Murphy, and Mack (Mack, 1998; Daniel, 2004); U.S. Pat. Nos. 6,019,059; 5,809,926 (Kelsey, 2000; Kelsey, 1998); Wayland (Norene, 2000). All of these designs have some undesirable design and stability characteristics that may have contributed to the lack of acceptance of this type of craft by the general surfing community.

Since the designs of conventional boards differ among types of boards (and in particular, between surfboards, and paipo and bodyboards), it is not unreasonable to expect that perhaps a similar situation may exist between types of hydrofoil boards. Hence it is worth noting that virtually all the disclosures with regard to hydrofoil craft via the patent process have been oriented toward surfboards (i.e. longer boards with the rider standing), while with only one exception, all the hydrofoil boards of which I'm aware that have been built and ridden have been paipo boards (i.e. boards at the short end of the size spectrum, and with the rider prone). The sole exception is the stand-up hydrofoil board of Hamilton, et. al., and, as will be discussed subsequently, this latter board is also somewhat unique even among stand-up boards in that it requires an exernal source of power to make the transition to flight mode, and to be towed onto the face of a wave.

As illustrated in FIG. 1, the face (3) of a breaking wave presents a unique environment for the operation of a hydrofoil craft since the sea surface is inclined (often steeply), curved (frequently substantially), and temporally changing (sometimes quickly). There are three slopes to the face of a wave that are important in the design and operation of a wave-riding board. The first of these is the slope of the face of the wave ("waveface slope"=tan $\theta_W$) at the location of the board as measured in a vertical plane orthogonal to the crest of the wave (4). The second is the slope of the wave face in a vertical plane passing through the longitudinal axis of the board ("longitudinal slope"=tan $\theta_T$). It is this slope that determines the magnitude of the force propelling the board and rider. The third is the slope of the wave face in a plane perpendicular to the path of the board ("transverse slope"=tan $\theta_T$). This latter slope, in combination with the design of the board, affects (in a generally adverse manner as the slope increases) the hydrodynamic characteristics of a conventional board with a planing hull. It also can adversely affect the hydrodynamic efficiency and the control of a foilboard, and presents unique design problems that appear to largely have been ignored in the prior art.

These three angles are related to each other via the path angle ($\theta_P$) of the surfer. This is the angle between the path of the surfer over the bottom and a line paralleling the wave crest. Numerically it is equal to the arc-tangent of the component of the speed of the surfer over the bottom in the direction of progression of the crest of the wave ($V_W$) toward shore divided by the component of the speed of the board parallel to the crest (4) of the wave ($V_C$):

$$\tan\theta_P = \frac{V_W}{V_C} \quad \{1\}$$

$$\tan\theta_L = \tan\theta_W \sin\theta_P \quad \{2\}$$

$$\tan\theta_T = \tan\theta_W \cos\theta_P \quad \{3\}$$

If the surfer changes the position of the board on the face of the wave such that the wave face slope is increased, both the propelling force and the transverse slope increase. As the speed of the board increases in response to this increase in the driving force, the transverse slope is increased and the hydrodynamic efficiency of the board decreases. Hence there is generally an optimum location for the surfer to position the board on the face of the wave to achieve maximum speed.

The earliest hydrofoil board of which I'm aware was designed by Gaylord Miller. A number of copies were built and ridden at Scripps Institution of Oceanography as early as the fall of 1960 (Kuhns and Shor, 1993; Hendricks, 1960). It is a hydrofoil paipo board, ridden prone, and consisting of a plywood hull (6), a single foil (7), and a large fin (8) separating the foil from the hull, as illustrated in FIG. 2. The hydrofoil paipo board designs by Lum and Wayland are similar.

FIG. 3 shows the cross-section of this board when it is positioned on the sloping face (3) of a wave (FIG. 1). The view in FIG. 3 is looking along the path of the board and the section is in the plane perpendicular to the trajectory (or "pathline") of the board. The magnitude of the transverse slope of the wave face at the location of the board has been chosen so that if it were any steeper, either the hull of the board (6) would be in contact the sea surface (9), or the end of the foil (7) would begin to pierce (or "broach") the sea surface, or both would occur. I define this critical transverse slope angle ($\theta_{DT}$) to be the "design transverse slope angle" (10) for the foilboard. Its magnitude is related to the configuration of the board by the equation:

$$\tan\theta_{DC} \cong \frac{2 \cdot S_{HF}}{W_H + B_F} \quad \{4\}$$

where:

$S_{HF}$=vertical spacing between the hull and the foil $W_H$=width of the hull $B_F$=span of the hydrofoil Numerical simulations of the hydrodynamics of an improved version of this configuration indicate that for a typical wave and surfer, the design transverse angle must be 24 degrees, or greater, for a foilboard to achieve the same speed as a conventional board. Except for the Hamilton et. al. and Kelsey designs, all the design transverse angles for the prior art range from about 9 degrees (Morgan; Bateman) to 22 degrees (G. Miller). Hence each of these designs will typically function as a "hydrofoil-assisted board" rather than a true hydrofoil board when traversing across the face of a wave. The design transverse angle is undefined for a board incorporating the Kelsey concept as the hydrofoil is intended to assist in the support of the board rather than support the board free of the water.

The potential for increased performance of a foilboard over a conventional board lies in the increased hydrodynamic efficiency of a foil compared with that of a planing hull. However, if the hull of a foilboard comes in contact with the sea surface, part of the load will be transferred from the foil to the hull, and the hydrodynamic efficiency will lie somewhere between that of a foilboard and a planing hull. Similarly, if a portion of the foil penetrates through the sea surface, the lift/drag ratio and wetted area of the foil will be reduced. This can increase the induced drag by forcing the foil to be operated at an increased angle of attack. Unless the friction and form drag of the foil are reduced by an equal or greater amount due to the reduced wetted area, the overall drag will increase and the speed potential of the foilboard will be compromised.

The Hamilton et. al. design is a unusual craft that mates the hydrofoil assembly from a water sports device (Woolley et. al., 1995) with a modified surfboard. It is intended to be ridden on large to giant shoaling and open ocean waves. In order for the standing rider to control the craft, the surfer is securely attached to the board by snowboard-style boots and bindings. Unlike a traditional surfboard, this surfboard requires an external source of power, such as a power boat or kite, to accelerate the board up to sufficient speed so that the foils can support the weight of the rider and board and then pull the board and rider onto the face of the wave to be ridden. The board is inherently unstable in both pitch and roll (i.e. similar to a unicycle) and hence must be balanced by the rider shifting his weight fore and aft, and from side to side.

Pitch instability is a deficiency of all the prior art except, perhaps, for the tandem surface-piercing designs disclosed in U.S. Pat. No. 3,747,138 (Morgan, 1973), or if one or more of the foils are broached. All of these craft depend on the rider to manually control the elevation of the hull above the sea surface (and, equivalently, the depth of the foil below the sea surface) by shifting his weight fore or aft. Typical speeds through the water are on the order of 16 to 33 feet/sec (Paine, 1974). For a hydrofoil board moving through the water at a speed of 20 feet/second, an error of only 1 degree in setting the angle-of-attack (AOA) of the foil will result in the elevation of the hull above the sea surface changing at a rate of about 0.4 feet per second. Hence the rider has very little time (less than 1 second for the prior art, except for the Hamilton et. al. design) to recognize the situation and make the appropriate corrections.

But that applies only when riding on a level sea surface. In order to operate on the face of a wave where the transverse slope angle approaches the design transverse slope angle without hull contact with the sea surface, or the foil broaching, the hull must be maintained at a unique elevation. Hence as the slope of the wave face increases and approaches the design transverse slope, the rider must make corrections for any deviation from this nominal elevation increasingly quickly.

The elevation of the hull will change unless the pitch angle of the craft relative to the sea surface results in an angle-of-attack that produces no accelerations of the board perpendicular to the sea surface. This pitch angle will change as the board is positioned higher or lower on the face of the wave; or as the board moves farther away from, or closer to, the breaking point of the wave; as the shape of the wave changes as it moves over a varying bathymetry; and especially as the rider executes maneuvers. Hence maintaining the hull elevation and avoiding hull contact or the foil broaching is a virtually impossible task for the rider. Personal experience with, and observations of, the G. Miller board in action reveal that the board is typically ridden with the foil broached. The same can be expected with the other prior art—with the Hamilton et. al. board being a notable exception. However, even with the large separation between the hull and the foils present in this latter design (which gives the rider more time to make a correction), it is a demanding and distracting task for the rider, and large amplitude variations in hull elevation are evident in a video of the craft in action (Laird, 2002). Thus some automatic means of assisting the rider in minimizing deviations of the hull elevation from its design height would be a highly desirable characteristic.

A canard configuration is commonly used in the design of small hydrofoil water craft, although not in the prior art of hydrofoil wave-riding boards. This configuration has a rear ("main") foil that supports two-thirds, or more of the total load, and a forward ("canard") foil that supports the remaining load. A primary function of the canard foil is often to regulate the elevation of the hull above the surface of the water within design limits. In some designs, it may also function as a rudder.

One of the most common means of achieving "automatic" control of the flight elevation with a canard foil is the use of surface-piercing foils. A typical design consists of two foil segments (11) which are joined together to form a "V"-shaped foil with either positive (FIG. 4A) or negative (FIG. 4B) dihedral. On a level sea surface, the foil will seek a depth where the vertical component of the lift forces generated by the two foil segments combine to match the total load superimposed on the pair. Any deviation from this equilibrium depth results in an increase or decrease in the wetted area, and a corresponding change in the lift force that acts to bring the foil back to the equilibrium depth. Alternative configurations based on the same principal may have the two sloping segments separated laterally to provide even greater roll stability, or the two sloping segments at the ends of a fully submerged foil segment.

All surface-piercing foils of this type introduce new problems if the foil is operated on a sloping sea surface (9). Since the foil segments are inclined, the force (direction and magnitude represented by the lines (12)) generated by each of the foils have both a vertical and horizontal component. On a level sea surface, the horizontal components of the two foil segments are equal and opposite directed, so they cancel each other. However, on a sloping sea surface, as in FIGS. 4A,B, the foil segment (11) on the high side of the slope will be more deeply submerged and have a greater wetted area than the segment on the other side. Hence that segment will generate a greater force than generated by the segment on the low side, and there will be a net lateral force.

This force can be significant. In the situation shown in FIGS. 4A,B (corresponding to a submerged foil area equal to one half the total foil area), the net lateral force will be 27 to 28 percent of the combined weight of the surfer and board. For a 150 pound surfer and board, this corresponds to about 40 lb. of force, and a corresponding torque of about 120 ft-lb. (for a 3 foot moment arm) around the yaw axis that tends to turn the board away from the face of the wave. Since the center-of-mass of the rider and board is above the center-of-effort of the forces generated by the two foils, there can also be a moment about the roll axis that acts to bank the board into the face of the wave. In the case of negative dihedral, the torque and the roll moment are in the opposite direction of those of the foil with positive dihedral.

Hence surface-piercing foils with positive dihedral (e.g. Bateman, 1991) and with negative dihedral (Morgan, 1973) lead to control problems for the rider when the board is operated on a sloping sea surface—and these problems will become even worse if the two foils are spatially separated from each other. These "unbalanced" conditions also become less manageable as the dihedral angle of one of the foil segments approaches the transverse slope angle of the sea surface—especially if the foil area and the speed through the water are such that the wetted area for equilibrium is about one-half the total foil area.

Another problem with conventional surface piercing foils is that the equilibrium depth varies as the square of the speed of the flow past the foil. Hence if there are large changes in speed, such as when maneuvering on a wave, there can be large variations in the equilibrium elevation of the hull from the design value. Thus the suitability of a traditional surface-piercing foil as the canard foil for a hydrofoil board is problematic.

Miller (1994) and Miller et. al. (1995) disclose an alternative approach for controlling the elevation of a hull of a hydrofoil sailboard above the sea surface. In U.S. Pat. No. 5,309,859, Miller discloses the design of a "surface-tracking" foil that takes advantage of the characteristic that a foil loses lift as the foil approaches the sea surface. Most of the change occurs when the foil is within a chord depth of the sea surface. Hence if the foil is small and of moderate or greater aspect ratio, the change in equilibrium depth with changing speed through the water will be small. The primary problem with this approach is that ventilation of the upper surface of the foil must be avoided if significant variations in the lift force generated by the foil are to be avoided. Thus, in combination with the dependence on the change in lift with proximity to the sea surface, the span of the foil must closely parallel the sea surface if ventilation of the foil is to be minimized.

In U.S. Pat. No. 5,471,942, Miller et. al. (1995) disclose another approach also based on the loss of lift as a foil approaches or emerges from the sea surface. In this case, the problems with ventilation are avoided by using a foil with a super-cavitating cross-sectional shape to promote continuous ventilation of the foil. They teach that the span of the foil must parallel that of the sea surface and disclose means to permit the foil (and its supporting strut) to swivel about an axis parallel to the longitudinal axis of the board so as to maintain this condition. The degree of rotation of the foil and its support in the plane defined by this axis is under the control of the rider. Alternatively, they disclose a foil with dihedral that does not require the control of the rider, but limits the bank angle of the board (rolled to windward) to a specific value (i.e. the dihedral angle). A third alternative is a foil in the shape of an arc of a circle. This allows more variability in the roll angle, but with a reduced surface tracking capability.

Both of these approaches suffer the same unbalanced lateral force problems as the surface-piercing foil discussed above when operated on an inclined surface. However, now the force imbalance is increased as there is no opposing second foil segment to partially counterbalance the lateral force generated by the surface tracking foil. Thus, although the surface tracking approach disclosed by Miller (1994) and Miller et. al. (1995) has the desirable property that the equilibrium depth of submergence of the canard foil on the speed through the water can be significantly reduced in comparison with a traditional surface-piercing foil, the lateral force unbalance problem is magnified.

All of the prior art using fully-submerged foils are unstable in roll and depend on the rider to balance the board by shifting weight from side to side unless the foil is broached. Morgan (1973) discloses designs with tandem inverted "V" shaped surface-piercing foils (as represented by FIG. 4B). On a level sea surface, a properly designed surface-piercing foil with positive dihedral can be stable in roll. But surface-piercing foils with negative dihedral are inherently unstable in roll (even more so than are fully-submerged foils). As noted above, this problem is exacerbated in the presence of a sloping sea surface. Hence it is unlikely that the rider will be able to balance these craft unless the board is banked such that the hull makes contact with the sea surface. A single surface-piercing foil with positive dihedral is disclosed in U.S. Pat. No. 5,062,378 (Bateman, 1991) and may be stable in roll. However, because of the small design transverse slope angle (~9 degrees), even a small amount of roll will put the hull in contact with the sea surface.

In U.S. Pat. No. 5,722,865, Tatum (1998) discloses a human-powered boat characterized by a very narrow hull. The rider sits atop a bicycle-like frame mounted on top of the hull. Hence the craft has a high center of gravity and is quite unstable in roll. He discloses a system with a vertical canard foil located ahead of the center-of-mass of the craft. The foil swivels around a vertical axis and is connected to the handle bars on the bicycle-like frame to provide roll control. Steering is controlled by a conventional vertically hinged rudder located well aft at the stem of the craft. Two small levers on the ends of the handlebar control the rudder. Hence both hands are required to provide both roll and steering control. Since the hull is narrow, and the center-of-mass of the rider is well above the center-of-buoyancy of the hull, the canard must have considerable wetted area to maintain roll control at the slower speeds. However, the presence of this wetted area adds to the surface friction drag of the craft at high speeds.

SUMMARY OF THE INVENTION

The primary objective of the present invention is a hydrofoil paipo board capable of superior maneuverability and speeds equal to, or in excess of, the speed of a conventional board with a planing hull. This is accomplished via a reduction in the induced drag. The improvement is a consequence of the increased lift slope (lift coefficient per unit angle of attack) for a hydrofoil in comparison with that of a planing hull, plus a substantially larger aspect ratio. Induced drag becomes especially important during maneuvering and hence the hydrofoil craft will carry significantly more speed through a maneuver.

A second objective is to achieve sufficient stability so that the average surfer can control the craft, yet sufficiently challenging that increasing skill will be rewarded with significant increases in performance.

A key feature of the invention is a pair of hydrofoils arranged in a canard configuration. The rear main foil is fully submerged and supports nearly all (90–100 percent) of the weight of the board and rider. The forward (canard) foil is a multi-function surface-piercing foil of a novel design that addresses the problems inherent in operating a hydrofoil board on a sloping and curved sea surface.

The canard foil is a horizontal, or nearly horizontal, double-ended foil whose span is perpendicular to the longitudinal axis of the hull. Only the tip of the canard foil on the wave side of the craft pierces the sea surface when foil-borne and traversing across the face of the wave. The wetted area at the tip of the foil has a low aspect ratio (normally 1 or less). Although predominantly horizontal, the foil may have a small amount of dihedral to compensate for the yawing moment created by the drag of the wetted tip of the canard foil.

A surface piercing, low-aspect ratio, canard foil has a number of benefits with regard to surface-following capability, pitch and roll control, and in maneuvering. For example, it automatically maintains the elevation of the hull above the surface of the wave within a small range of values (as is necessary to obtain the benefits of a suitably chosen design transverse slope angle). A potentially significant disadvantage is that drag created by the canard foil is substantially increased in comparison with an equally loaded (per unit area), fully-submerged, high aspect ratio, subcavitating foil.

However, as the canard foil carries only a small fraction of the total weight of the rider and board, even with an increased drag per unit load supported compared with a fully-submerged, subcavitating type foil, this drag is a relatively small percentage of the total drag. Moreover, to a considerable degree this loading is under the control of a skilled rider via shifting weight fore and aft. The proximity of the rider and location of the canard foil allows easy and rapid monitoring of the depth of penetration of the tip of the canard foil to guide the surfer in making these adjustments.

The board is maneuvered by banking it to make turns, as with a conventional surfboard (and with an airplane). The prone position of the rider and the weak stability of the craft in roll promote high roll rates and enhance the maneuvering capability compared to maneuvering when the rider is standing. Large accelerations can be generated during aggressive maneuvering, hence secure contact between the rider and the board is vital. The prone rider's primary contact points with the board include the area of the stomach, hips, elbows, and forearms. A pair of fixed grips affixed to the hull provides an even more secure connection between the rider and the board. A kneeboarder bent forward, resting his forearms on the deck of the hull, and hanging onto the grips may also be able to ride the board—although at some sacrifice in maneuvering performance. However, it is highly doubtful if the board can be ridden with the rider standing.

This board has excellent maneuvering and speed performance and is of relatively simple construction. However the performance can be further enhanced, and maneuvering control improved, by the conversion of the pair of grips into a pair of control handles that can be manipulated by the rider to allow the surfer to alter the rigging angle of the canard foil, and to deflect control surfaces incorporated into the trailing edge of the main strut assembly.

The rider executes a control command by movement of the appropriate control handle. To minimize accidental command inputs during maneuvering, inputs consist of upward and downward rotations around the wrist joint (i.e. about an axis perpendicular to the plane of the hand and passing through the wrist joint). This also allows the controls to be manipulated without the rider needing to shift any of the points of contact with the hull. The control handles can also be locked into, and released from, a default position, or range of positions, to add even more security from accidental inputs.

DESCRIPTION OF DRAWINGS

Unless otherwise noted, all the drawings show my invention, all side views are from the right side, and all hinge points include a composite sleeve bearing or one of the hinge components is of a suitable bearing material.

FIG. 1 is a perspective view from forward and slightly to the left (shoreward) of the longitudinal axis of a canard-configured paipo board ridden by a prone surfer traversing across the face of a wave.

FIG. 2 is a perspective view of the Gaylord Miller hydrofoil paipo board as viewed from below and in the right forward quarter of the craft.

DESCRIPTION OF THE INVENTION

Figure 3:
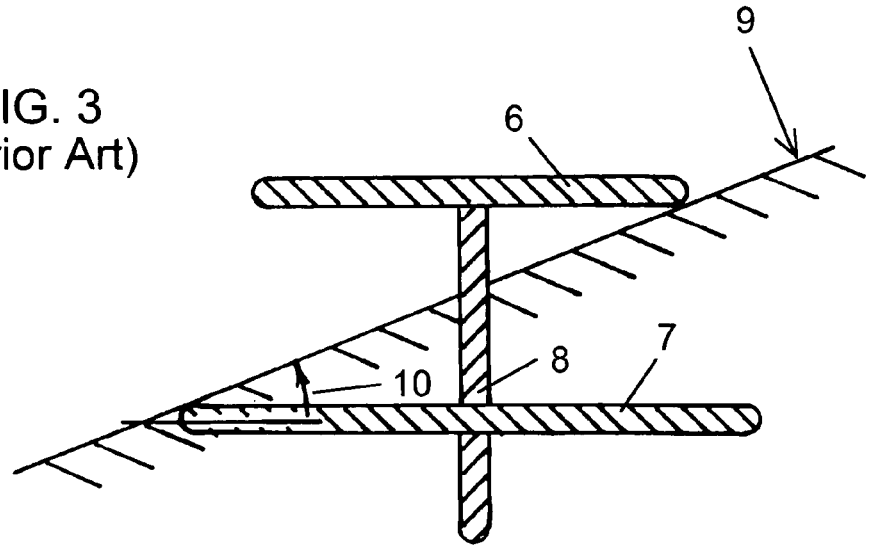
FIG. 3 (Prior Art)
FIG. 3 is a sectional view of the Gaylord Miller hydrofoil paipo board through a plane perpendicular to the pathline of the craft while it is traversing across the face of a wave.

My invention is a surfboard incorporating a fully-submerged hydrofoil and a novel surface-piercing hydrofoil arranged in a canard configuration as shown in FIGS. 1, 5, 6, and 7. The preferred riding position is with the surfer prone. This position has a number of significant benefits. First, the board and rider are more compact than a kneeling or standing surfer, and thus the board and rider fit better into the "curl" of the wave. Second it is a more stable position for the rider when aggressively maneuvering the board. Third, the resulting moment of inertia about the roll axis is reduced, so the roll rate will be increased and the maneuvering capability enhanced.

It can also be ridden kneeling by bending forward, resting the elbows and arms on the deck of the craft, and grasping the hand grips. However, some maneuvering capability and control stability will be sacrificed. It is unlikely that the craft can be ridden in the standing position. As discussed in the Background section, the stance of a stand-up surfer compromises the rider's stability in the lateral direction—yet this is direction of greatest accelerations and least stability of the craft. In addition, the rider cannot hang onto the hand grips, which contribute significantly to the security of the prone or kneeboard rider on the craft. It might be possible for a highly skilled surfer to ride it in a standing position by incorporating snowboard boots and mounting plates into the deck, as in the Hamilton et. al. design. But this would make the board totally impractical as a "paddle-in" craft that does not need to rely on external power to get into flight mode and positioned on the face of a wave.

As in traditional surfing, the rider catches the wave under his own power, using his arms to paddle, or by kicking with swim fins, or both. As the surfer catches the wave and begins to accelerate, the craft rises and "flies" above the water supported solely by two hydrofoils (14,15). This transition to flight takes place without any effort on the part of the rider. Once the board and surfer are moving with the wave, the rider maneuvers and trims the craft on the face of the wave by shifting weight from side to side, or fore and aft, in much the same manner as with a conventional stand-up surfboard, kneeboard, paipo board, or bodyboard. The most significant difference is that in some instances where the surfer on a conventional board would typically shift weight forward—as in trimming for maximum speed—the skilled hydrofoil paipo board rider will shift weight aft to transfer more of the total weight onto the more efficient main foil. The basic stability and the control requirements of the board are within the capabilities of the average surfer. In a preferred embodiment, a pair of hand controls and control surfaces are added to the basic configuration to enhance both performance and control.

The basic version of the craft consists of a hull (13), a rear main hydrofoil (14), a pair of main strut assemblies (20) connecting the main hydrofoil to the hull, a forward (canard) hydrofoil (15), a canard strut assembly (16) connecting the canard hydrofoil to the hull, an adjustable linkage assembly (22) between the canard strut assembly and the hull that allows the rigging angle of the canard foil to be altered, and a pair of grips (18) to assist the surfer in maintaining his position on the board. One or more foam pads (19) can also be added to the deck of the board to provide a higher friction contact surface to further secure and cushion the contact between the rider and the board.

The hull can be constructed using the same materials and methods as in building a traditional board with a planing hull. The designer has considerable latitude in the shape of the hull since it is clear of the water when racing across the face of a breaking wave at maximum speed. However, the hull (13) should be contoured so that the center-of-mass of the rider in the typical riding position will be forward of the center-of-effort of the main foil by a distance corresponding to about 5 percent of the separation between the centers of effort of the main (14) and canard (15) foils—yet still allow the rider to shift position by at least the same amount forward or aft of this position to allow changes in the loading on the canard foil. The rear of the craft should extend sufficiently aft of the rider's center of mass so as to provide support, but not extend so far aft as to sigiuficantly interfere with the rider kicking his or her swim fins when paddling out to the surf break or when catching a wave.

Similarly, the hull should have a low buoyancy and only partially support the rider. This avoids interference with kicking the swim fins when swimming out to the break and facilitates "duck-diving", if necessary, under an approaching breaking or broken wave when getting out to the break. A leash of the type commonly used to connect a surfer with his board is not practical with the hydrofoil paipo board since it will easily become entangled with the main or canard foil, or with the strut assemblies, or with the grip or control handles and control assembly. If the craft is no longer under the control of the rider (e.g. due to a wipe-out while riding on a wave), the craft will tend to tumble if struck by a breaking wave, or by the moving bore from a broken wave. A low buoyancy hull tends to minimize the extent of this tumbling and hence the rider need not swim as far before regaining control of the craft following one of these incidents.

The primary purpose of the rear (main) foil (14) is to support nearly all (i.e. 90–100%) of the combined weight of the board and the rider. This foil is fully-submerged and of a subcavitating type in order to maximize hydrodynamic efficiency and to decouple the orientation of the lift force that it generates from any dependence on the slope of the sea surface. The area, planform, and aspect ratio of the main foil can be varied to suit the characteristics of a specific surf break or to serve the particular interests of the rider (e.g. speed vs. maneuvering). A planform wetted area of 1 square foot per 100 pounds of rider and board weight and an aspect ratio between 3 and 4 are representative starting points. A good rigging angle for the main foil has an angle-of-attack (AOA) that results in zero lift for free stream flows approximately paralleling the bottom of the hull. This minimizes drag while paddling and catching waves.

The main foil hydrofoil is unswept. This is in contrast to the designs disclosed by Morgan (1973), who argues that the hydrofoils on a hydrofoil surfboard should be swept back by an angle of 30 to 45 degrees. Although this range of angles coincides with the range of path angles (previously defined in the Background section) that occur when a surfer is traversing across the face of a wave, this does not mean that the flow of water past the board is at this angle relative to the longitudinal axis of the board, as stated by Morgan. Instead, the longitudinal axis of the board is along the path angle. This follows not only from vector mathematics, but it is also readily evident in pictures of surfers riding on waves that are taken looking down from overhead. Since sweep results in a reduced lift coefficient per unit angle of attack, sweeping the main foil aft would increase the induced drag, and result in a main foil that would not track the movements of the canard foil as well as an unswept foil.

The hull has a short semi-streamlined foil (40) protruding from the bottom of the hull. This facilitates carrying the assembled board through doorways, etc., and also serves as a grip for the rider if paddling the board upside down (which can be convenient when transiting from the beach out to the surf break).

The canard foil (15) controls the elevation of the hull, contributes stability about the roll axis, participates in maneuvering, and supports the remaining 0–10 percent of the weight of the rider and board. The characteristics of this surface-piercing foil are a key element in the design of the craft. As with the main foil, it is unswept.

One of the prime functions of the canard foil is to automatically control the elevation of the hull above the sea surface. Sweeping the foil back, and the resulting reduction on the lift coefficient per unit angle of attack, would result in reduced control of this elevation.

Figure 8:
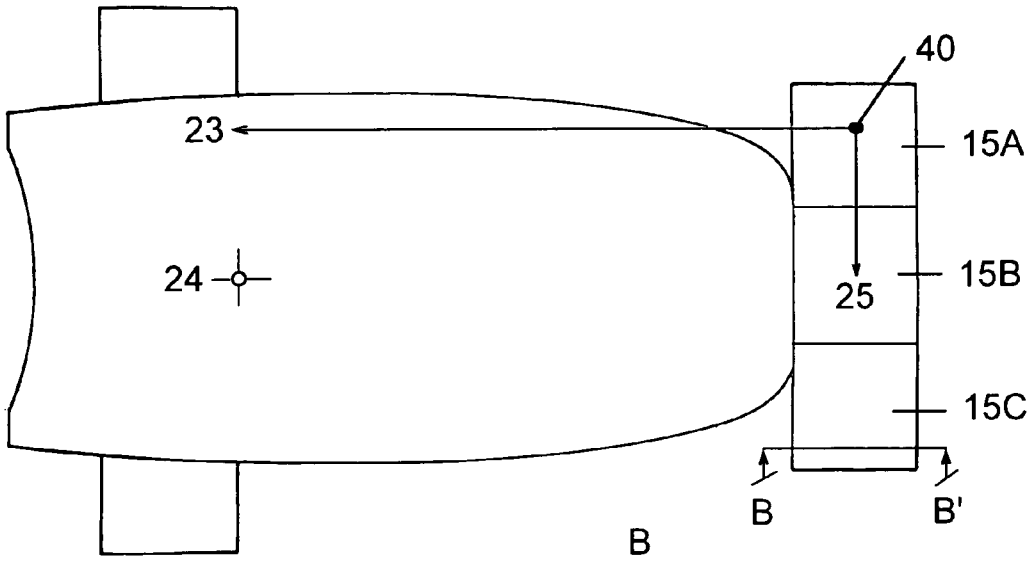
FIG. 8 is a top view illustrating the division of the canard foil into three foil sub-segments according to function, plus the balancing of torques around the yaw axis.

Functionally, the foil can be divided into three segments across its span as illustrated in FIG. 8. These comprise: a left surface-piercing foil or left "tip" foil (15A), a right surface-piercing foil or right "tip" foil (15C), and a center or "bridging" foil section (15B). Each segment comprises about one-third of the total span of the canard foil. Most of the time when riding a wave (FIG. 1) only a portion (5) of one of the tip segments pierces into the face of the wave. The center section functions primarily as a structural element and is normally not in contact with the sea surface unless the board is headed toward shore (a transient event, unless the wave has overtaken the surfer and he is just heading "straight-off" in front of the resulting bore of foam and water). It also hydrodynamically "bridges" between the two tip segments when the craft is rolled from a bank to one side to the other when maneuvering.

Figure 4A:
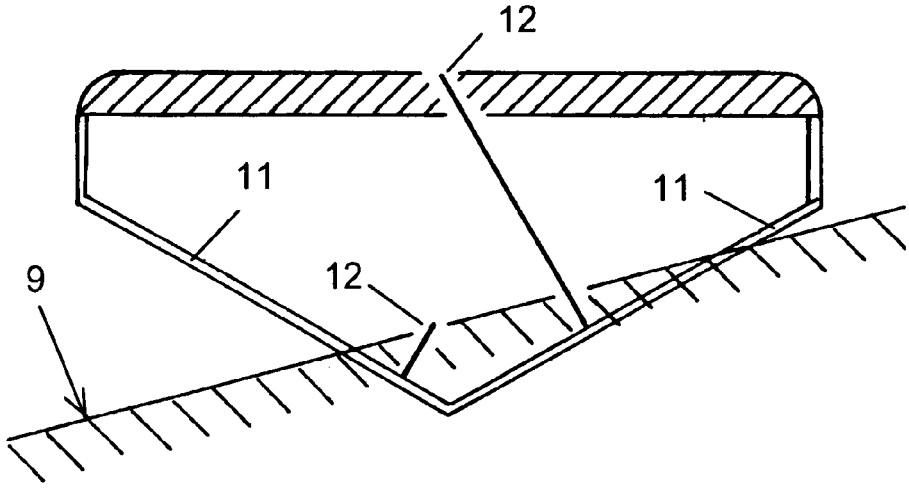
FIG. 4A (Prior Art)
FIG. 4A is the front sectional view along the longitudinal axis of a foilboard with a typical "V" type surface-piercing foil with positive dihedral.
Figure 4B:
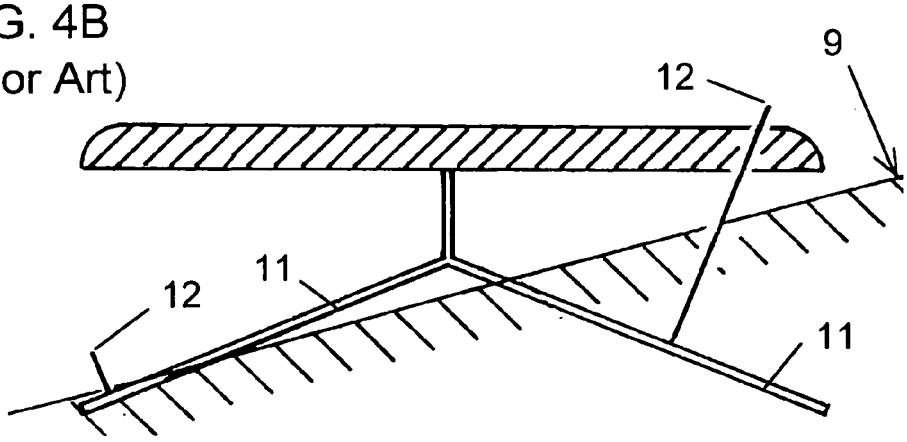
FIG. 4B (Prior Art)
FIG. 4B is the front sectional view along the longitudinal axis of a foilboard with a typical "V" type surface-piercing foil with negative dihedral.

Since this foil has no dihedral, the only forces created by the canard foil lie in the plane that is orthogonal to the span of the foil, and no lateral forces are created. This is in contrast to the surface-piercing foils disclosed in Morgan (1973), who shows and describes surface-piercing hydrofoils that are inclined to give a negative dihedral of "approximately 22 degrees". This corresponds to the situation shown in FIG. 4B, and discussed in the Background section, where it was shown that a unbalancing force of significant magnitude will be created and present significant control problems for the rider.

The span of the wetted area of the surface-piercing foil tip is easily observed by the rider since it is only about one to two feet from the surfer's face and within easy view.

Typically the rider will adjust position on the board such that only about one-half of the tip area (or one-sixth of the total span), or less, is piercing the sea surface. The remaining unwetted area of that tip serves as a reserve as the foil automatically "corrects" for changing loads, while maneuvering, during changes in speed through the water, or when recovering from an unusual attitude (such as when "landing" a "free-fall" take-off when catching a wave). The skilled rider will adjust position along the longitudinal axis of the craft so as to reduce the load on the canard foil in order to maximize the hydrodynamic efficiency of the foilboard.

A typical aspect ratio (hydrofoil span divided by its average chord) for the entire canard foil is about 3. Hence the aspect ratio of each tip is about 1, and a typical aspect ratio for the wetted area piercing into the face of the wave is around 0.5. This low aspect ratio leads to a number of important differences between its characteristics and those of more traditional surface-piercing foils of greater aspect ratio. Some of these differences are beneficial for the foilboard, while others are undesirable.

The primary disadvantage is that a low aspect ratio foil generates more drag for the same lift when compared with a high aspect ratio foil. In the case of a fully submerged foil, the increased angle of attack for the low aspect ratio foil results in increased induced drag. However in the case of a surface piercing canard foil working in combination with a fully submerged main foil, the additional drag is primarily in the form of increased parasitic drag of the foil resulting from increased wetted area. In addition, since the foil is operating near the surface and the spanwise ventilation path for the submerged tip is short, the upper surface of the foil is often ventilated. Hence the lift coefficient of the foil (per unit angle of attack and unit wetted planform area) is decreased to roughly half that if ventilation were not present. This leads to further wetted area and increased drag.

However, this loss of efficiency is mitigated to a substantial degree by choosing the canard configuration and minimizing the load carried by the canard foil since the drag force is related to the loading carried by the foil. The design range is 0–10 percent of the total weight supported by the canard. But in practice, the loading is more typically 0–5 percent. This is again in contrast to the designs disclosed by Morgan (1973) in which the placement and uniform planform area of the tandem foils suggests that all the foils are intended to be equally loaded. Hence the load on his surfacing-piercing foils are about 50 percent of the total load, or approximately 5 to 10 times the loading on my surface piercing foil.

On the other hand, with a low aspect ratio foil the changes in the elevation of the hull in response to changes in the speed through the water, or to variations in the loading of the front foil, are reduced in comparison to the changes that would occur with a high aspect ratio surface-piercing foil. Thus the low aspect ratio foil provides better control of the elevation of the hull above the water.

The lift force generated by the wetted area of the tip of the foil is given by the equation:

$$F_L = \left(\frac{1}{2}\rho V^2\right)\cdot A_W \cdot C_L \cdot k \cdot \sin\alpha \qquad \{5\}$$

where:

$F_L$=lift force

ρ=density of water

V=speed of flow past the foil $A_W$=wetted area of the foil=b·c b=wetted span of the tip of the foil c=average wetted chord k=aspect ratio correction factor α=angle-of-attack of the foil (relative to the angle of attack for zero lift)

The aspect ratio correction factor, k, is approximately given by the equation (adapted from McCornick, 1979):

$$k = A_R \cdot \left[\frac{4}{A_R + \left(2\frac{A_R+4}{A_R+2}\right)}\right] \qquad \{6\}$$

where $A_R$=aspect ratio of the foil (=b/c).

For aspect ratios ≦1, the term in the brackets is roughly constant and equal to 1. Hence the lift equation becomes:

$$F_L \cong \left(\frac{1}{2}\rho V^2\right)\cdot (b\cdot c)\cdot\left(\frac{b}{c}\right)\cdot C_L \cdot \sin\alpha = \left(\frac{1}{2}\rho V^2\right)\cdot b^2 \cdot C_L \cdot \sin\alpha \qquad \{7\}$$

The change in depth of submergence, Δd, of the foil is related to the change in the wetted span, Δb, of the foil, and to the transverse slope of the wave face at the location of the foil, through the equation:

$$\Delta d = \Delta b \cdot \tan\theta_T \qquad \{8\}$$

where $\theta_T$ is the transverse slope angle defined by equation {3} in the background section. Thus the equilibrium elevation of the hull above the sea surface varies almost linearly with changing speed through the water, rather than approximately as the square of the speed as with surface-piercing foils of greater aspect ratio. Hence the elevation of the hull above the sea surface is less sensitive to speed changes.

Similarly, the lift generated by the foil also increases as the square of the wetted span, rather than linearly on the span as with traditional surface piercing foils of greater aspect ratio. Hence, since wetted span is proportional to the depth of submergence via equation {8}, the lift generated by the foil increases approximately as the square of the depth of submergence. Therefore it doubles if the foil is depressed to a depth 41 percent greater than its equilibrium depth (and quadruples if the foil is depressed to twice its equilibrium depth). By way of comparison, for a surface-piercing foil with a large aspect ratio, the foil depth would have to increase by 100 percent to double the lift. Conversely, the lift force created by the low aspect ratio foil decreases by 50 percent if the foil rises 29 percent of the way to the sea surface from its equilibrium depth, and disappears as the foil reaches the surface. A high aspect ratio foil would have to rise 50 percent to decrease the lift force by the same 50 percent.

Hence variations in the elevation of the hull above the sea surface foil are reduced by about 40 percent in comparison with a high aspect ratio surface-piercing foil, and the low aspect ratio foil does a considerably better job of tracking the sea surface than a conventional surface-piercing foil of greater aspect ratio, such as those disclosed by Morgan (1973) and Bateman (1991).

The magnitude of these changes in hull elevation are relatively small for the hydrofoil paipo board. For example, if the transverse slope at the location of the canard foil is 25 degrees and the wetted span of the foil tip is 3.5 inches (one-sixth of the total span of the canard foil, and one half the span of a tip foil for the craft shown in FIG. 5), then the change in the elevation of the hull associated with a 100 percent increase in the loading of the canard foil would be about 0.7 inch (deeper), and the decrease in depth associated with a 50 percent reduction in the loading would be about 0.5 inches. Similarly, a doubling of the speed through the water will result in a 50 percent reduction in the wetted span, and the depth of submergence would be reduced by 0.8 inches. Since speeds typically vary over a wide range when riding and maneuvering on the face of a wave, this is a desirable property of the design.

A change in the elevation of the forward foil produces a change in the angle-of-attack (AOA) of the rear foil. Since the rear foil has a substantially larger aspect ratio than the wetted area of the canard foil, it responds rapidly to small changes in its angle of attack and tracks the motions of the canard foil. Hence the forward foil provides a simple and satisfactory solution to the need for automatic control of the elevation of the hull above the sea and relieves the rider of the burden of that task, and also eliminates or mitigates hydrodynamic inefficiencies and stability problems present in the prior art of hydrofoil wave-riding boards.

However, there is room for additional improvement. Since the tip of only one end of the canard foil is wetted when traversing across the face of a wave, the location (40) of the center-of-effort of the lift force generated by the canard foil is displaced laterally from the center of the craft, as illustrated in FIG. 8. The rider compensates by shifting weight to that side of the craft—a shift that is also necessary with a conventional board. Since the canard foil is lightly loaded, the required shift in the rider's center of mass is small.

The generation of lift by the wetted tip of the canard foil also generates drag (23). The offset location of this drag creates a moment arm around the yaw axis (24) of the craft. The resulting moment tends to turn the craft into the face of the wave. The magnitude of this torque is on the order of 1.5 ft-lb., or less than 1.5 percent of the torque associated with the "V" type surface-piercing foils illustrated in FIGS. 4A,B. Although the rider is easily able to compensate for this by slightly rolling the board toward the wave face and introducing a little bit of "skidding" yaw, a more desirable solution is to compensate by adding a small amount of positive dihedral to the canard foil. The presence of this dihedral introduces a lateral component to the lift force that is directed toward the centerline of the craft (25) and away from the face of the wave. This force has a large moment arm about the yaw axis (e.g. ~95 percent of the separation of the centers of effort of the canard and main foils), so only a small force (and small dihedral angle) is required to balance the torque associated with the canard drag.

However, this balance depends on the ratio of the wetted area of the foil to the total area of the foil and will change with changing speed of the board or fore and aft trimming by the rider. A better balance can be achieved by symmetrically curving the foil in the spanwise direction into the form of a parabolic arc according to the equation:

$$y = \left(\frac{\beta}{2L_C}\right) \cdot x^2 \qquad \{9\}$$

where:

y=elevation of leading edge (=0 at centerline)

x=lateral distance along leading edge (=0 at centerline)

β=lift/drag ratio for canard foil (including induced drag)

$L_C$=longitudinal distance between yaw axis and canard foil center-of-effort

When riding in the prone position, the surfer's face is only about 18 inches away from the tip of the canard foil and the wetted portion of the tip of the foil is within the rider's peripheral vision. This proximity is beneficial in monitoring the trim of the craft, but can be a significant problem if the foil throws spray forward and/or upward. This possibility is greatly reduced by introducing a convex curvature into the bottom of the foil so that the AOA of the forward portion of the bottom of the foil is significantly less than the angle-of-attack defined by the chord line from the leading to trailing edge of the foil. The super-cavitating section designated "C" in FIG. 17 of U.S. Pat. No. 2,890,672 (Boericke, 1959), and the slightly modified version illustrated in FIG. 9 (a cross-section view of section B_B' in FIG. 8) are examples of foil sections that meet this requirement.

Figure 9:
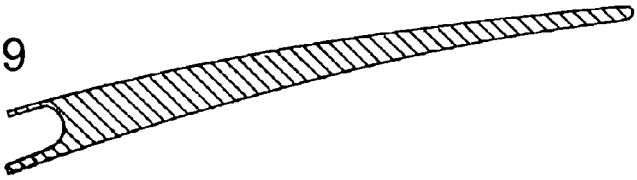
FIG. 9 illustrates the cross-section of a suitable canard hydrofoil section through section B_B' in FIG. 8.
Figure 10A:
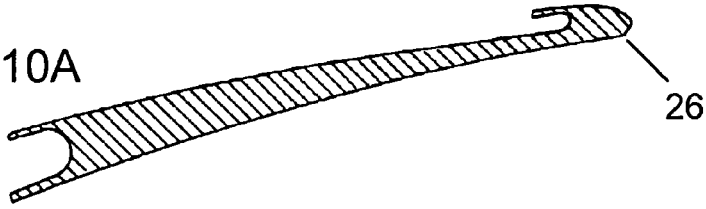
FIG. 10A illustrates an alternative cross-section for a canard foil section with a rounded and chamfered leading edge through section B_B' in FIG. 8.

FIG. 10A shows the addition of a rounded leading edge to the foil illustrated in FIG. 9. Although this increases the amount of spray and drag generated, it may be a desirable modification if the board is being ridden in an area crowded with other surfers. In order to ensure that any water thrown forward from the underside of the foil parts cleanly from the leading edge without being drawn upward around the leading edge as it leaves the foil (due to the Coanda Effect), there should be a sharp chamfer (26) at the junction of the leading edge of the foil with the bottom surface.

Figure 10B:
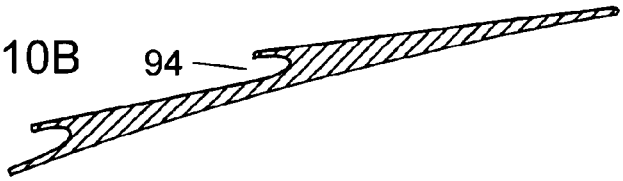
FIG. 10B illustrates an alternative cross-section for a canard foil section with an undercut step on the top surface through section B_B' in FIG. 8.

FIG. 10B shows an alternative foil section with the addition of an undercut step (94) on the upper surface of the foil illustrated in FIG. 9. This assists in maintaining a ventilated state on the upper surface of the foil when operating at low speeds.

The fully-submerged main foil as an entity is neutrally stable in roll. Calculations show that with the offset center of lift, the surface-piercing canard foil is stable in roll for small roll angles. In combination, roll stability is relatively weak, but sufficient to allow the rider to control the craft. Conversely, this minimal stability permits high roll rates without the need for large weight shifts by the rider. As noted earlier, roll rates are also maximized by the surfer riding in a prone position on the board so as to minimize the rider's moment of inertia for rotations about the roll axis. The end result is a very responsive and agile craft. Riding in the kneeling position results in a somewhat slower rate of roll than when riding prone, but the roll rate is still substantially greater than if the rider were standing.

Morgan (1973) does not discuss the roll stability of his surface-piercing foils with negative dihedral. Calculation of the stability on a sloping surface is not straightforward and depends on the inclination of the sea surface, the dihedral angle of the foil, and the fraction of the foil area that is submerged. However, surface-piercing foils with negative dihedral are known to be inherently unstable on a level sea surface, so it is likely that there will be combinations of sea slope, dihedral angle, and foil loading that also lead to roll instabilities on the face of a wave.

The performance benefits of the hydrofoil paipo board over a traditional board with a planing hull are primarily associated with the reduction in the induced drag. This reduction results from approximately a doubling in the lift coefficient per unit wetted planform area of the (main) foil over a planing hull with the same aspect ratio and angle-of-attack, and the substantially greater aspect ratio of the main foil over that of the typical planing hull of a conventional board.

The induced drag becomes especially important when the craft is maneuvering. For example, if the surfer executes a coordinated turn with a bank angle of 60 degrees, the load doubles, and the angles-of-attack of both the main foil and the planing hull approximately double to support that load. Hence the resulting induced drag approximately quadruples from its value prior to executing the turn. Since the induced drag of the foilboard is a substantially smaller fraction of the board's total drag than is the induced drag for a conventional surfboard, when executing the maneuver the percentage increase in the total drag for the conventional board increases more than for the foilboard. Calculations estimate a that conventional board traveling at about 15 mph will decelerate during the execution of a turn with a 60 degree bank angle at a rate that is about 1.7 times greater than that of the foilboard.

Numerical simulations also indicate that if the rider is traversing across the face of the wave at 20 feet/second (~13.5 mph) and not maneuvering, the total drag of the hydrofoil board will be about 60 percent of that of a conventional board going the same speed. Hence for identical propelling forces, the rider on the hydrofoil board should be able to go faster than the rider on the conventional board. As discussed in the background section, the propelling force is proportional to the slope of the wave face at the location of the surfboard hull (or main foil) on the wave. Hence positioning the board where the slope is steeper should increase the speed. However, there is a limit to the benefits of this approach due to the need to fit the rider into the tube-like contours of the breaking wave without making contact with the water (an advantage of the prone and kneeling positions), to changes in the characteristics of the flow field in the wave face, and to changes in the hydrodynamic properties of a planing hull operated on a sloping sea surface.

Figure 5:
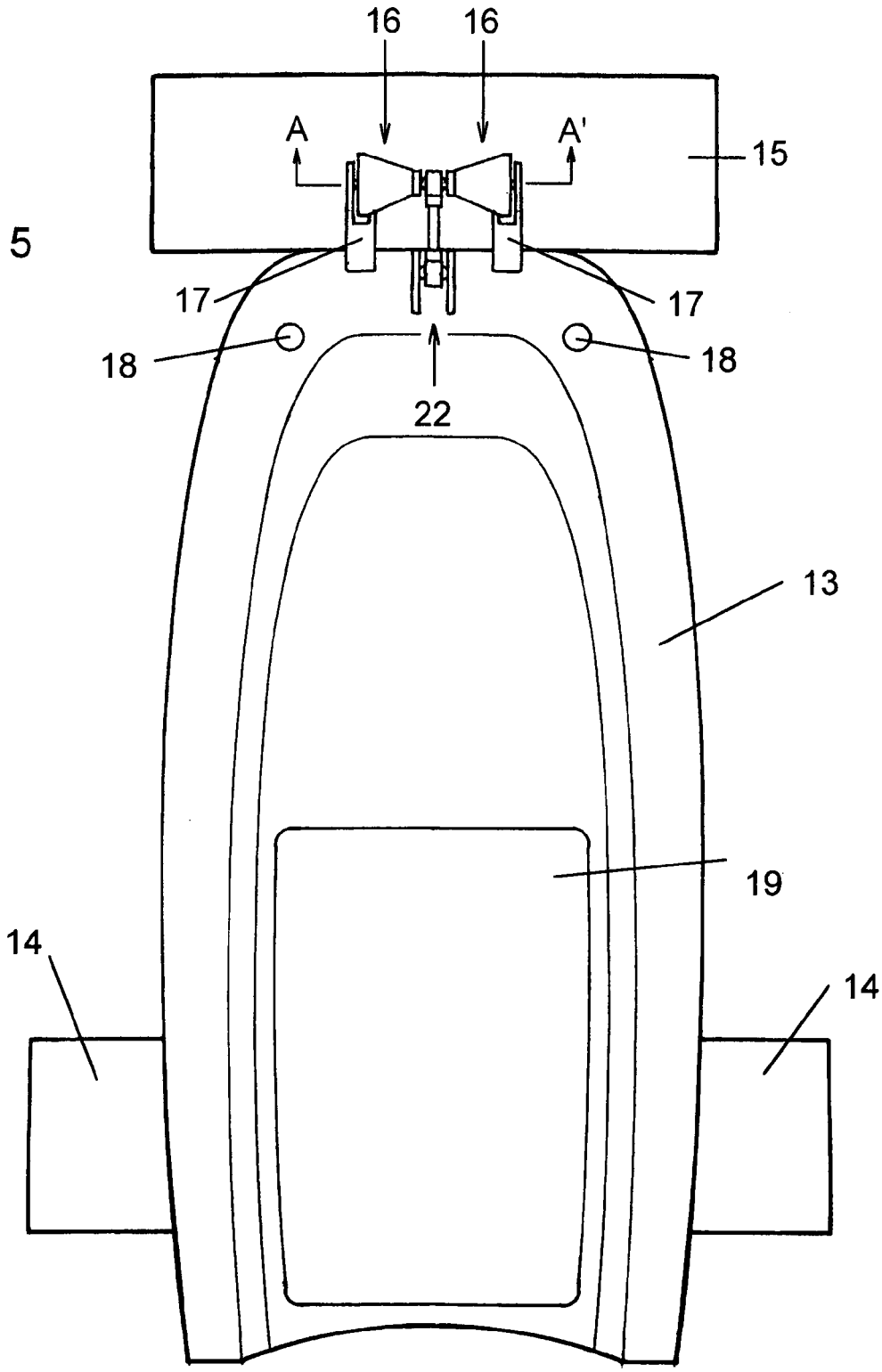
FIG. 5 is the top view of my basic hydrofoil paipo board.
Figure 6:
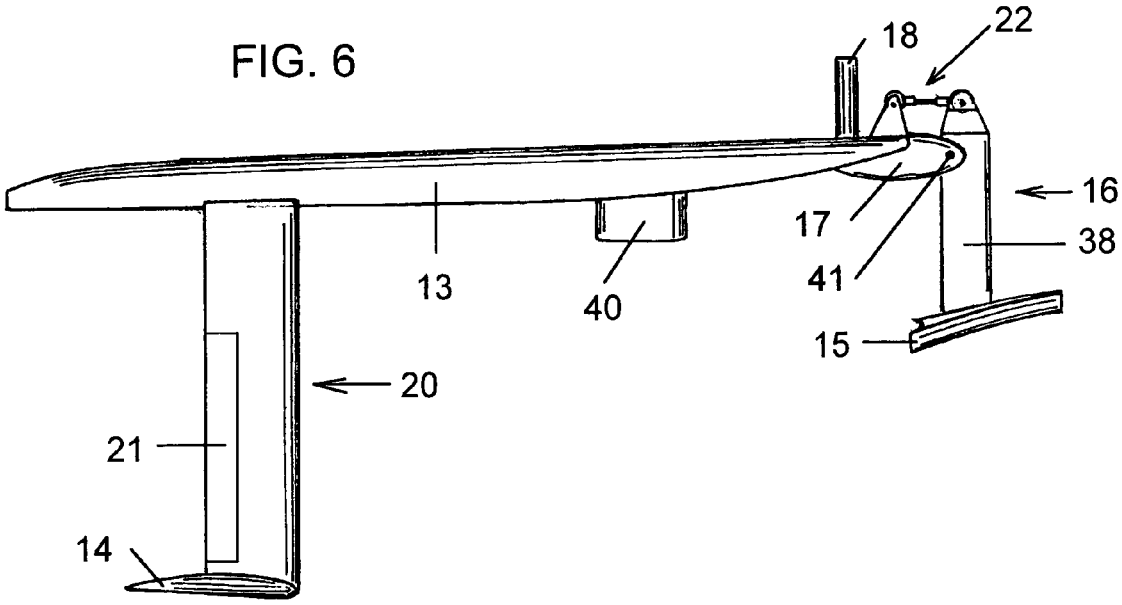
FIG. 6 is the right side view of my basic hydrofoil paipo board.
Figure 7:
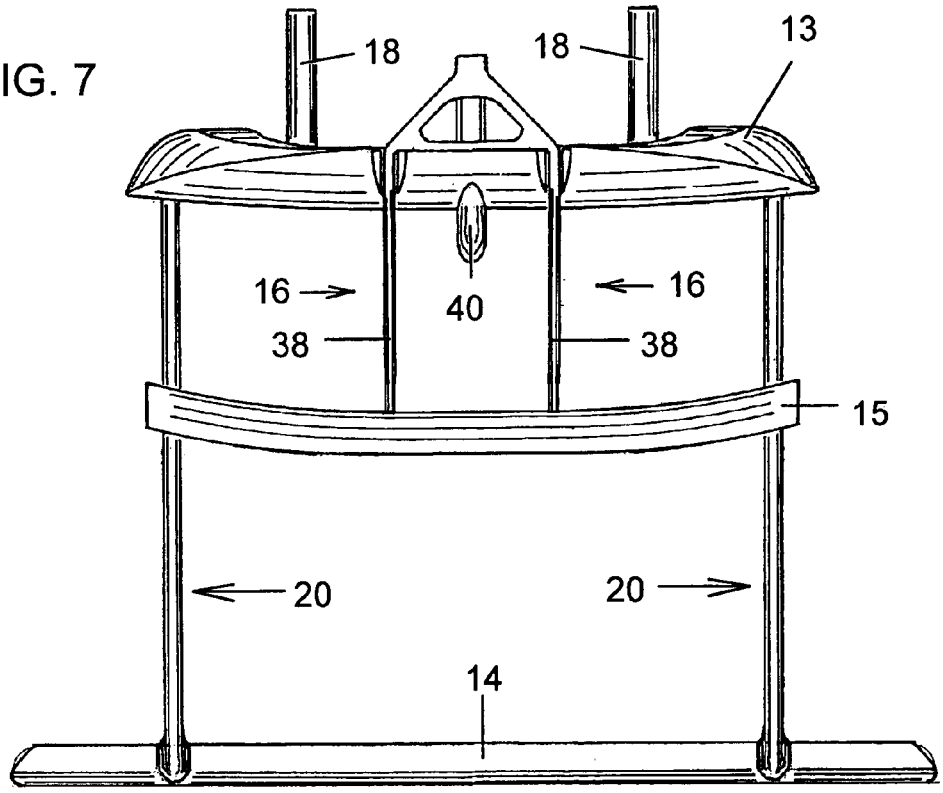
FIG. 7 is the front view of my basic hydrofoil paipo board.

Observations and numerical simulations indicate that the optimum wave face slope for a conventional surfboard is commonly about 45 degrees. As noted in the background section, calculations indicate a well-designed hydrofoil board with a skilled rider should be able to equal this speed where the transverse slope angle is 24 degrees. The design slope angle defined by equation {4} in the background section for the craft illustrated in FIGS. 5, 6, and 7 is 36 degrees. With the addition of the canard foil, a second design transverse slope angle exists and is computed by substituting the canard span for the width of the hull in equation {4}. For the craft shown, this angle is 23 degrees.

However, this is actually a lower bound for a transverse wave slope that avoids contact between the hull and the sea surface, or the main foil broaching, since the latter equation assumes that: (a) the tip of the canard foil is just touching the wave face and, (b) the transverse slope of the wave at the location of the canard is the same as at the location of the main foil. On a progressively breaking wave, the slope of face of the wave at a fixed elevation on the face diminishes with distance forward from the breaking crest (FIG. 1). In addition, when traversing across the face of the wave, the wave face slope increases with increasing elevation (up to the point where the wave face becomes vertical). The canard foil of the craft illustrated in FIG. 5 is about 3 feet forward of the main foil. In the speed calculations, the longitudinal slope at the position of the main foil is about 33 degrees. Hence the elevation of the canard foil on the face of the wave will be about 1.5 feet lower than if there were no longitudinal slope to the craft's path. The transverse slope at the location of the tip of the canard foil will depend not only on the elevation of the forward foil, but also on the details of how a specific wave breaks. But in any case, both factors will reduce the transverse slope relative to the transverse slope at the location of the main foil. The end result is that effective minimum design transverse slope angle for the craft shown will be greater than 24 degrees.

Moreover, the design transverse slope corresponds to the first onset of a reduction in the hydrodynamic efficiency of the hydrofoil board due to contact of the hull with the sea surface or broaching of the main foil. So although the drag coefficient for the foilboard may begin to increase as the hull comes in contact with the sea surface, the benefit of a steeper longitudinal slope and the associated increase in driving force may still dominate for transverse slopes slightly larger than the design transverse slope. Hence the craft illustrated in FIGS. 5–7, meets the design objectives of superior maneuvering capability and a speed potential equal to, or in excess of, that of a conventional board.

Nevertheless, if the rider wishes to further increase the speed potential of the board, this can be accomplished by individually—or in combination—decreasing the width of the hull (13), increasing the length of the main strut assemblies (20), shortening the length of the canard foil strut legs (38), and decreasing the span of the main foil (14) or the canard foil (15), or both. This flexibility and customization of the board configuration is possible since the board disassembles into the hull the canard and main strut assemblies, and the canard and main hydrofoils. This disassembly also makes transport and storage of the craft much more convenient.

Figure 11:
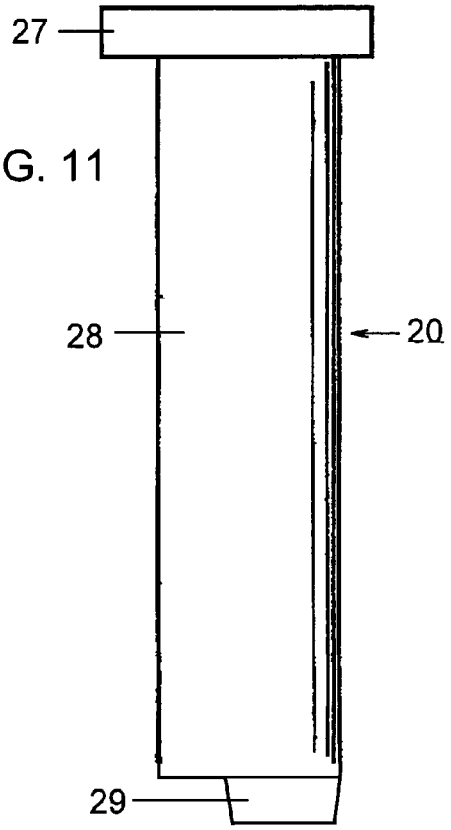
FIG. 11 is a side view illustrating a basic main strut assembly.

The main strut assembly (20) for the basic version of the invention is shown in FIG. 11. It consists of a streamlined strut (28) of composite construction, a mounting block (27) at the upper end of the strut (where the strut attaches to the hull), and a tapered blade-like section (29) extending downward from the bottom end of the strut.

Figure 12:
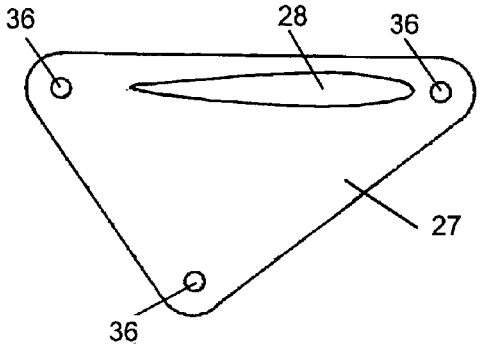
FIG. 12 is a top view illustrating the mounting block on the top of the main strut.

FIG. 12 shows the details of the attachment (27) block at the top of the main strut assembly. The upper end of the strut (28) extends through, and is bonded to, the interior of the block (27), forming a thick flange-like termination on the end of the strut. Holes (36) are drilled through the block at the three corners to secure the block to the hull and resist deflections of the strut along either the longitudinal or transverse axes of the craft. These holes are countersunk on the lower face of the block to receive flat-head machine screws. To attach a strut assembly to the hull, this block is inserted into a matching recessed receptacle in the bottom of the hull, three corrosion resistant, flat-head machine screws are inserted into the holes (36), and then screwed into a nut-plate incorporated into the hull.

Figure 13:
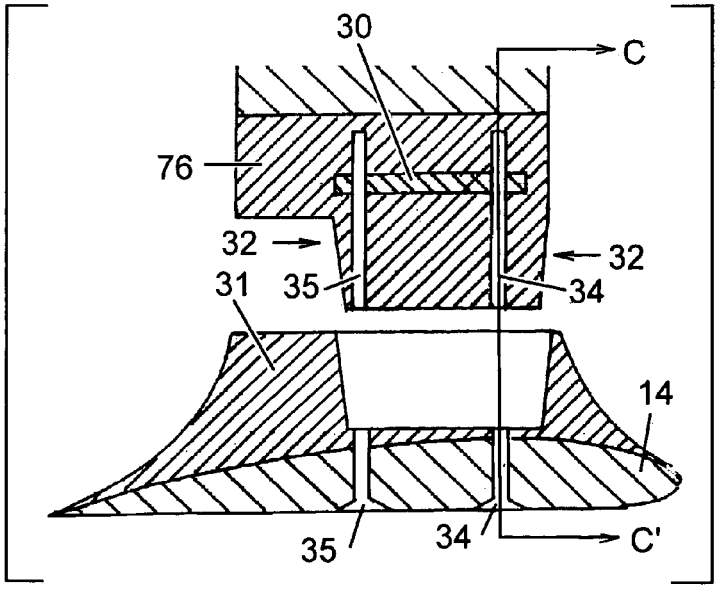
FIG. 13 is the cross-section view through the midplane of the lower main strut illustrating the means of attachment to the main foil.
Figure 14:
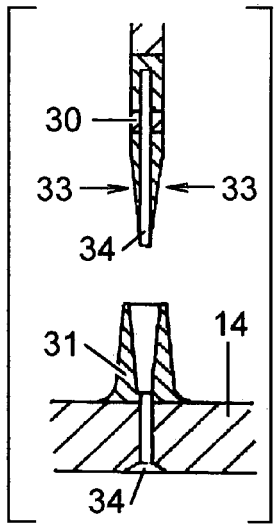
FIG. 14 is the cross-sectional view of the lower portion of the main strut and main foil in section C_C' of FIG. 13.

The details of the mating of the strut (28) with the main foil (14) are shown in FIGS. 13 and 14. FIG. 13 shows the cross-section of the main strut in a plane passing through the plane of symmetry of the strut, and through the cross-section of the main foil at the point of connection. FIG. 14 illustrates the cross-sections of the lower main strut and the main foil corresponding to section C_C' in FIG. 13. Near the bottom of the strut, the strut is tapered on both the sides (33) and on the leading and trailing edges (32). The core in this area is also replaced by a material with greater compressive strength (76) to cope with the higher localized loads. Embedded in this reinforced core is a corrosion resistant nut-plate (30) which has been drilled and tapped to receive a pair of corrosion resistant machine screws. Drilled holes (34,35) lead upward from the bottom of the strut to the nut-plate. A mating tapered receptacle (31) is bonded to the main foil (14), and the vertical holes (34,35) in the strut continue through this receptacle and terminate in countersunk recesses in the bottom of the main foil. The main foil is secured to a main strut by inserting two flat-headed machine screws (not shown) through the main foil, up to and through the nut plate (30), and tightened.

Figure 15:
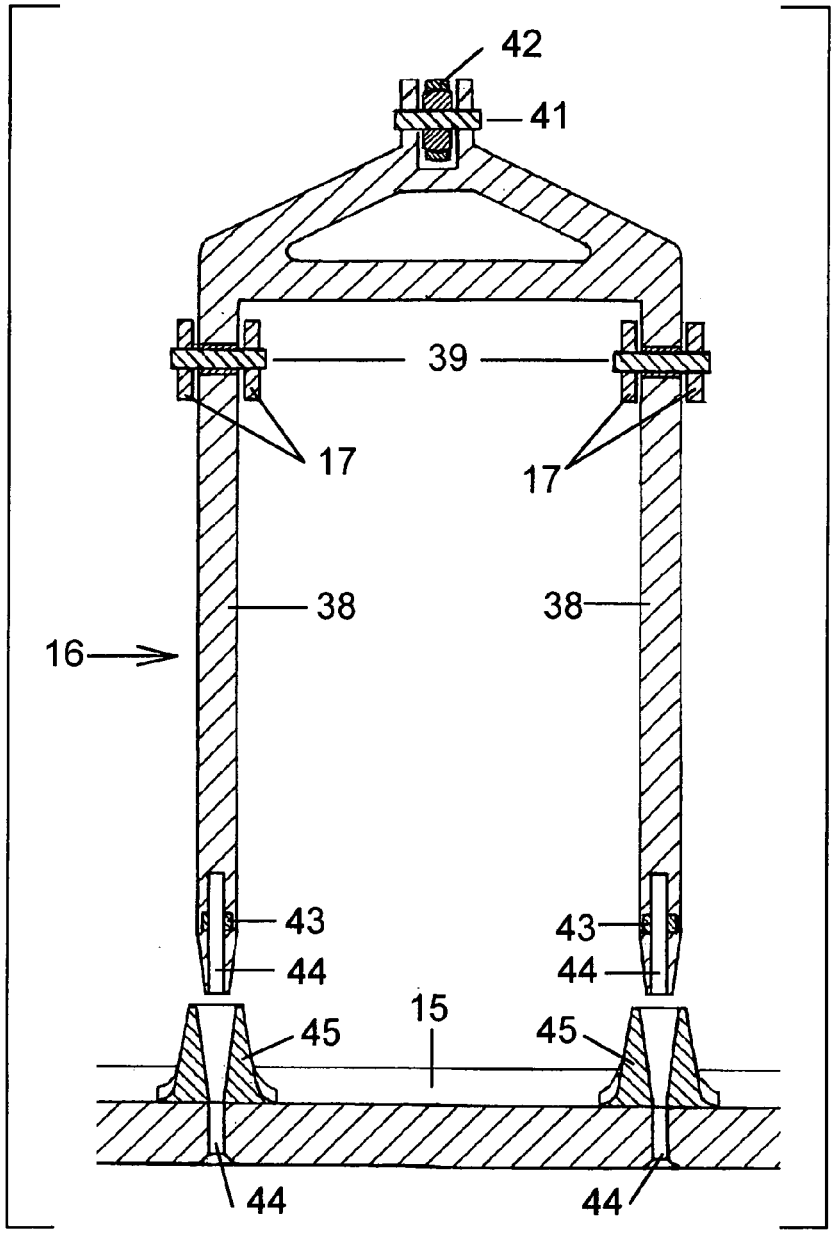
FIG. 15 is a sectional view, through section A_A' in FIG. 5, illustrating the canard strut assembly and the means of attaching the canard foil to the canard foil strut.

FIG. 15 shows the cross-section of the canard strut assembly (16) through section A_A' in FIG. 5, and the details of the attachment of the canard foil (15) to the canard strut assembly. The strut assembly consists of a pair of vertical struts (38) connected to each other via a triangular open frame at their upper ends. The struts and frame are of composite construction. The canard strut assembly is attached to hull (13) by slipping each of the two struts (38) between the pair of plates extending forward from the pair of protrusions (17) projecting out from the front of the hull (see FIGS. 5,6). The legs of the protrusions (17) and the canard strut legs (38) are drilled, and a pin is inserted to form the primary hinge (39) for the canard strut assembly. Rotations of the canard strut assembly about this axis change the rigging angle of the canard foil. There is also a U-shaped recessed structure at the apex of the triangular frame at the top of the two struts. This has a pair of holes drilled through the sides. A pin inserted through these holes, and through a tie-rod end (42) connects the canard strut assembly (16) to the canard rigging angle assembly (22) (FIG. 5) and forms the secondary hinge (41) for the canard strut assembly.

The canard strut assembly is joined to the canard foil in a manner analogous to the joining of the main struts to the main foil. The lower ends of the strut legs (38) are reinforced, tapered, drilled (44), and a nut-plate (43) embedded into each. This assemblage is inserted into matching receptacles (45) bonded to the canard foil (15). Flat-head machine screws (not shown) are then inserted into the holes (44) at the bottom of the canard foil, and screwed into the nut plates (43) in the strut legs.

The bridging section (15B) (see FIG. 8) assists in making smooth transitions between support from one foil tip section to the other, and, on occasion, can assist in supporting the bow of the craft when the canard foil makes contact with the sea surface at unusual entry angles. Conversely, it can also occasionally have some undesirable qualities. Most notable is that the total area of the canard is quite large, which can make it difficult to exit from being carried along with the bore of water and foam from a broken wave if the rider found it necessary to straighten out to avoid getting hit by the breaking wave. This problem can be mitigated by removing the bridging section so that the canard foil (15) becomes two canard foils (15A, 15C), with each new foil supported by one of the strut legs (38). However, these legs would have to be strengthened to take the bending moments induced by the loads carried by either canard foil.

Figure 16:
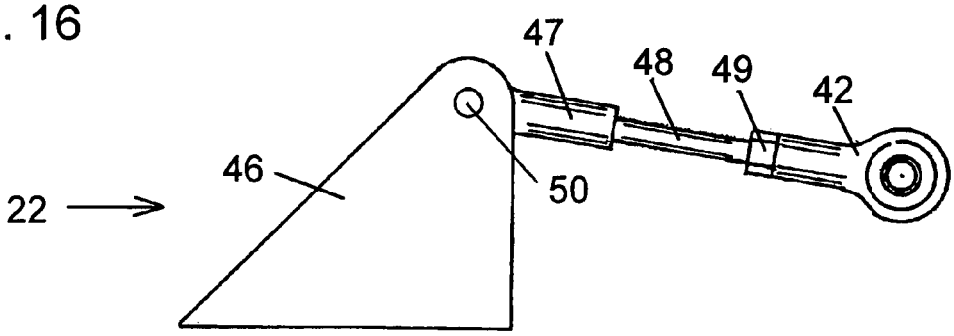
FIG. 16 is a right side view of the canard foil rigging angle assembly.

FIG. 16 shows the details of the canard rigging angle assembly (22). This assembly allows the rigging angle of the canard foil to be adjusted. A pair of support plates (46) are bonded to the upper deck of the hull (13) as shown in FIG. 5. These plates are drilled to receive a hinge pin (50) and straddle a tie-rod end (47). A tie-rod (48) leads forward to a second tie-rod end (42) at the secondary hinge point (41) for the canard strut assembly. The rigging angle of the canard foil is adjusted by screwing the rod deeper, or less deeply, into the tie-rod ends. A nut (49) secures the desired setting.

The craft so described comprises a basic version of the hydrofoil paipo board. It is relatively simple in design and construction, yet the elements discussed integrate together to provide excellent speed and maneuvering capabilities. However, in the preferred embodiment additional performance and enhanced control is achieved by providing means for the rider to control the rigging angle of the canard foil, and to manipulate a pair of new control surfaces (21) integrated into the main struts (see FIG. 6), while paddling the craft and when riding on a wave.

Figure 17:
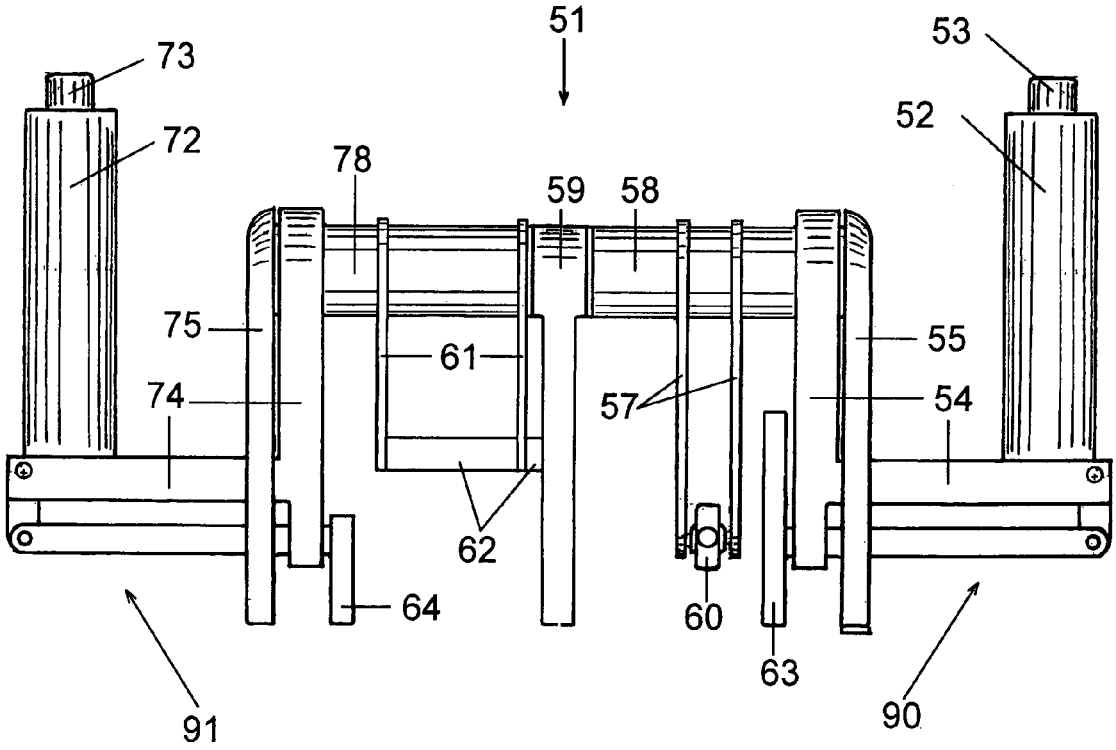
FIG. 17 is a rear view of the flight control assembly.
Figure 18:
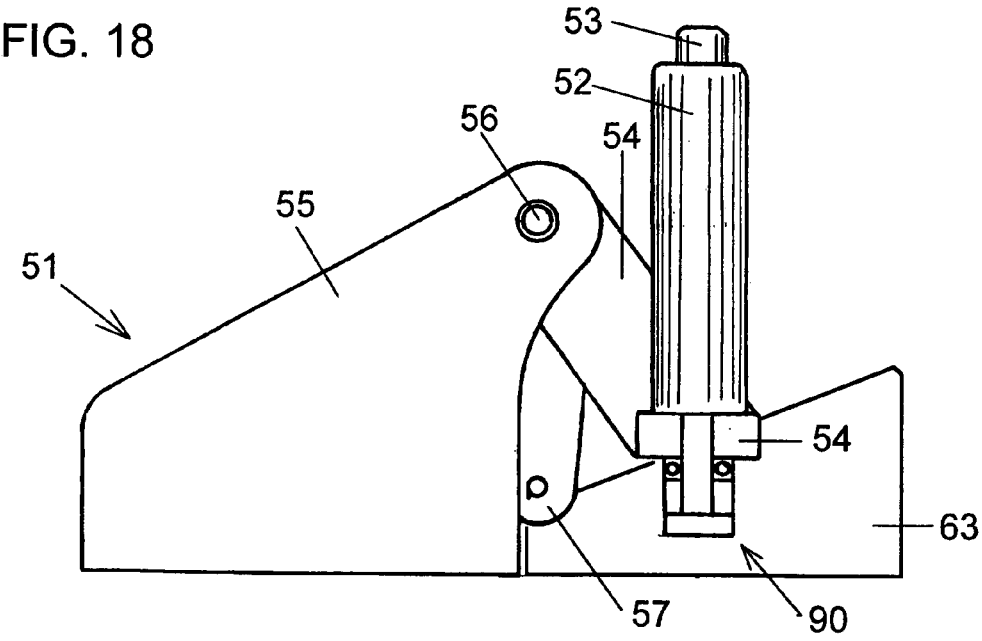
FIG. 18 is a right side view of the flight control assembly.
Figure 19:
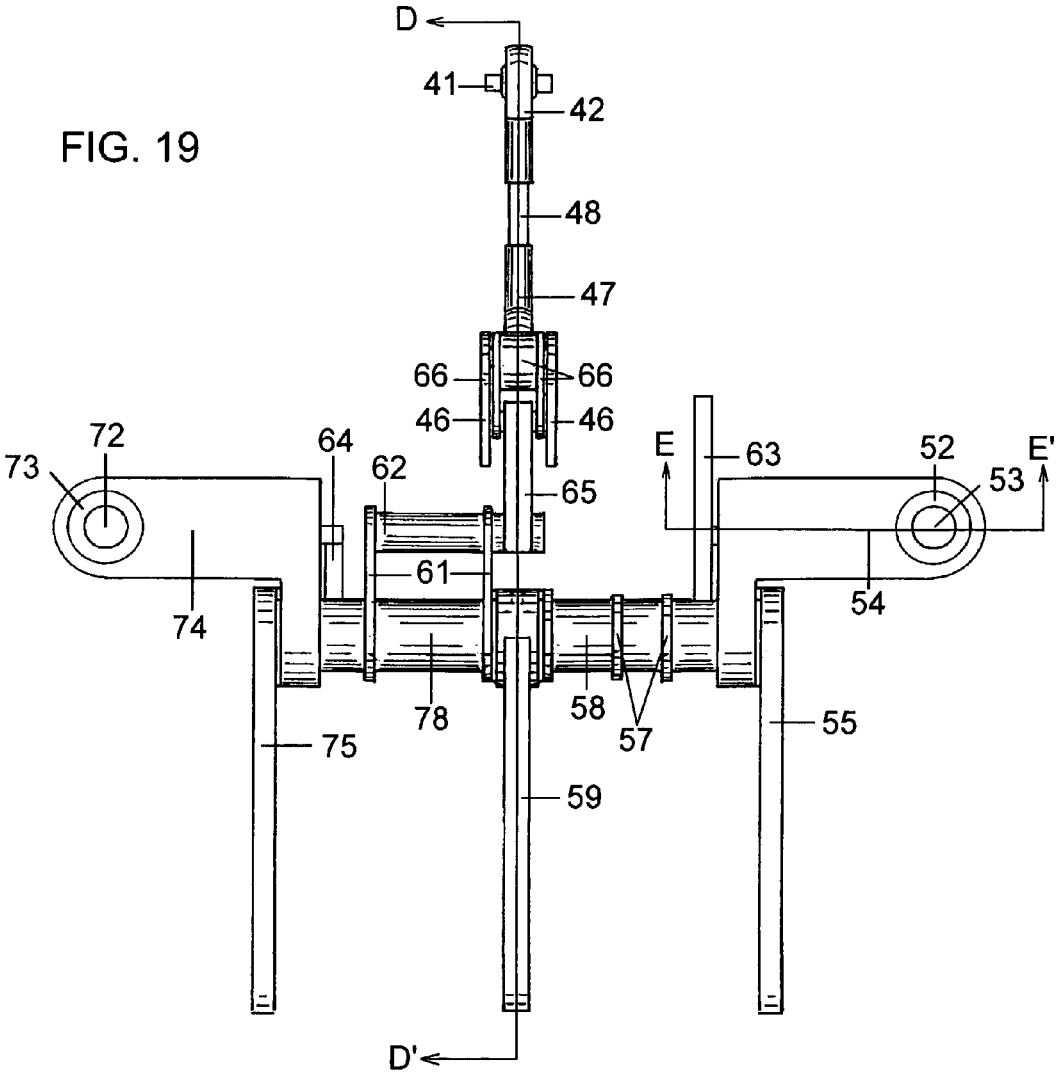
FIG. 19 is a top view of the flight control assembly and the canard linkage assembly.

FIG. 17 shows the rear view of the control assembly (51), and comprises two sub-assemblies. The left sub-assembly controls the rigging angle of the canard; the right, the deflection of the control surfaces. The two assemblies are essentially left-right mirror images of each other except for their respective control movement output arms (57,61,62). FIG. 18 shows the right side view of the control assembly, and FIG. 19 shows the top view (plus the linkage from the canard control assembly to the canard strut assembly). The control sub-assembly for the main strut control surfaces (21) will be discussed in detail below, but the discussion applies as well to the sub-assembly for the canard control (with the exception of the final output arms).

The sub-assembly begins with a vertical control handle (52) gripped by the rider. This handle is attached to a bracket (54) that runs from under the handle toward the center of the hull, then turns back 90 degrees and extends back and upward to connect to a control torque tube (58). This torque tube rotates on a shaft (56) (FIG. 18) supported by a cantilevered right-side support (55) and one-half of a center support (59). The output arms (57) for the control surfaces (21) are also attached to the control torque tube, lead downward away from the tube, and terminate at a hinge point connecting the two arms to a tie-rod end (60). Rotations of the control handle about the axis (56) convert to nearly linear fore-and-aft motions at the end of the output arms. Parts (72),(74), (75) and (78) are the canard control analogs of (52),(54), (55) and (58). The output arms (61,62) differ somewhat from those for the control surface control (57). The arms (61) are attached to the control torque tube (78) but project forward as well as downward. They terminate in a control rod (62) that cantilevers over to the centerline of the craft and then terminates at a hinge joint (69) (FIG. 20) that connects to a link bar (65).

Figure 20:
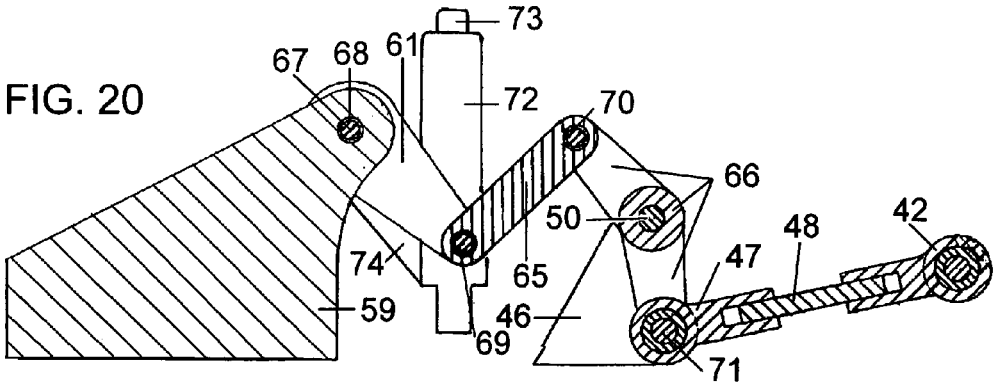
FIG. 20 is a cross-sectional view through section D_D' in FIG. 19 of the flight control assembly and the canard linkage assembly.

FIGS. 19 and 20 illustrate the linkage between the canard control sub-assembly and the canard strut assembly. FIG. 20 is a cross-sectional view through section D_D' in FIG. 19. The link bar (65) connected to the control rod (62) through hinge joint (69) extends forward and upward and connects to one end of a walking-beam bellcrank (66) at hinge joint (70). This bellcrank pivots around the hinge joint (50) at the pair of support plates (46). In the basic version, this hinge joint was the termination point for the canard rigging angle adjustment assembly (22), consisting of tie-rod end (47), tie-rod (48), and tie-rod end (42). Now, however, tie-rod end (47) that used to connect to hinge joint (50) connects instead, to the opposite end of the bellcrank (66) at hinge joint (71).

Pushing the top of the control handle (72) forward rotates torque tube (78) and shaft (67) in bearing (68). This rotation causes bellcrank (66) to rotate counter-clockwise. This moves tie-rod end (47), control rod (48) and tie-rod end (42) to the right, displacing hinge pin (41) (FIG. 15) and rotating the canard strut assembly (16) so as to diminish the rigging angle of the canard foil to an angle that results in zero lift. Pulling the top of the control handle all the way back increases the rigging angle to increase to twice the default value (the default value occurs when the handle is vertical—as in FIGS. 17–20). There are a number of other approaches that could be used for the control system and which will be evident to a person skilled in the art of mechanical control systems. For example, if the canard control arms (61) were oriented upward when the control handle is in the default position, the tie-rod (48) in the canard rigging assembly could be lengthened so that tie-rod end (47) would terminate at control arms (61) yielding the same canard rigging angle changes illustrated in these figures, and all the intervening mechanism (62,65,66) could be eliminated—but at the expense of a significantly taller control assembly.

It is desirable that the accelerations that the rider experiences when riding and maneuvering the board not result in unintentional control inputs. One way to minimize these inputs is to use up-down rotations about the wrist joint for the control inputs. The control handle (52) (FIG. 18) is located forward of its point of rotation (56). The relative locations of the handle and the rotational axis are chosen so that the axis of rotation is concentric with the axis of rotation of up-down wrist rotations when the rider is gripping the control handle. A comfortable range of rotation for this wrist motion is about +25 degrees from the central (default, upright) position. These wrist rotations do not require that the points of contact of the forearm and elbow of the rider be moved, increasing the security of those contact points and helping the rider maintain his position on the board. In addition, the wrist muscle of the typical rider is estimated to be sufficiently strong so as to resist rotational torques resulting from forces on the rider corresponding to accelerations of up to two times, or more, that of gravity. However, anyone familiar with control systems will easily be able to design a similar control system for rotations about any of the other five degrees of freedom for the rider's hand for various trade-offs between simplicity of construction of the control system and the degree of isolation from accidental and unintentional control inputs.

However, since the craft can also be ridden at high performance levels without the need for controls—as in the base configuration—two latching assemblies (90, 91) provide means to lock the control handles into their default positions for even greater security if control inputs are not required or desired. To move the control handles from this default position, a release button (53,73) on the top of the control handle (52,72) is depressed and held down. The control handle can then be moved through its entire range of motion.

Figure 21:
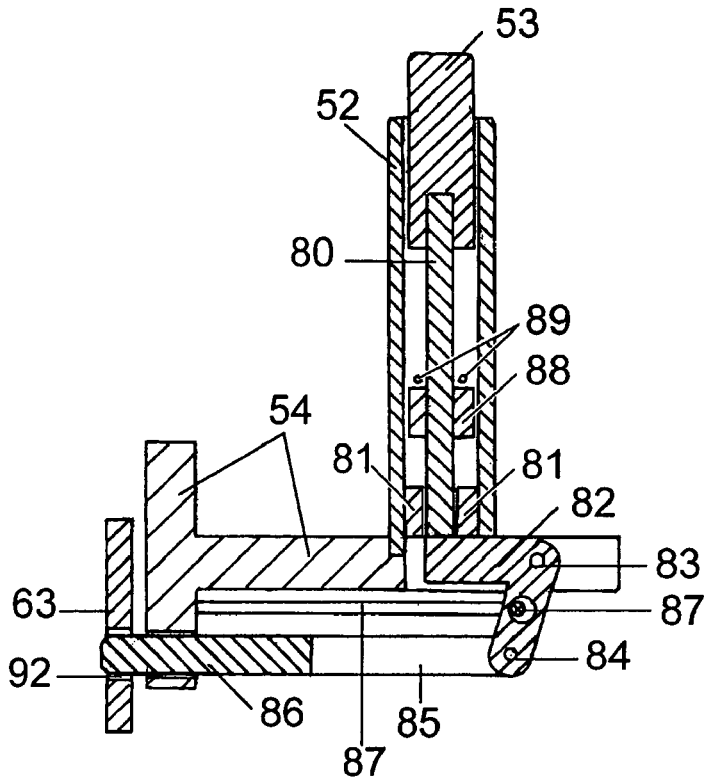
FIG. 21 is a cross-sectional view through section E_E' in FIG. 19 of a flight control handle and latching assembly

The details of this mechanism for assembly (90) are illustrated in FIG. 21. The latter is a cross-sectional view through section E_E' in FIG. 19. Assembly (91) is the mirror image of assembly (90).

The release button (53) connects to a push rod (80). This rod extends down through, and terminates at the end of, sleeve bearing (81). When release button (53) is depressed, it slides down the interior of the control handle and moves the push rod (80) downward. The emergence of the push rod from the sleeve bearing presses down on one end of bellcrank (82), causing it to rotate counter-clockwise around hinge point (83). This, in turn causes the opposite end of the bellcrank (82) to move hinge pin (84) outward from the center of the craft. The outer end of latching fork (85,86) is pinned to hinge point (84), so it also moves outward. In doing so, it extracts the inner end of the latching fork (86) from the hole (92) in latching plate (63), thus freeing the control handle for rotations. The shock cord (87) running from support arm (54) through the hole in bellcrank (82) and back to support arm (54) causes the latch fork to attempt to re-engage in hole (92) if the button is released. This will not occur until the control handle (52) is moved back to the default position.

Sleeve (88) is bonded to push rod (80) and limits the downward motion of the push rod. A U-shaped wire clip inserted through a pairs of holes (89) on one side of the control handle, across the interior of the handle, and exiting out another pair of holes on the opposite side limits the upward motion of the push rod and release button, preventing them from falling out, yet also permitting the button and push rod to be removed, if desired. The protruding ends of the wire U clip are bent around the handle, and the handle wrapped in bicycle handlebar tape to secure the clip, release button, and push rod in place. The latching fork (85,86) resembles a tuning fork. The outer part (85) consists of two legs that straddle the bellcrank (82). Midway along its length, it changes to a single cylindrical leg (86) that extends through the guide hole in the support (54) and into the hole in the latch plate (63).

Figure 22:
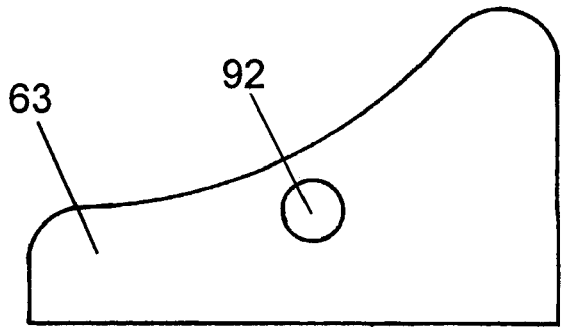
FIG. 22 is a right side view of the latch plate for either the ruleron or the canard incidence flight control latching assembly.
Figure 23:
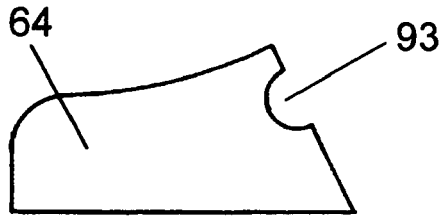
FIG. 23 is a right side view of an alternative latch plate for the canard incidence flight control latching assembly.

FIG. 22 shows the location of the hole (92) in latching plate (63) in which the control handle is locked into a single position unless the release button is depressed to extract the latching fork from the hole. FIG. 23 shows an alternate plate (64) that some riders may find desirable for limiting the motions of the canard control handle. In this case, the forward portion of latching plate (63) has been removed, leaving only one-half of a hole (93). This design prevents the canard rigging angle from being reduced below the default value unless release button is depressed, but allows the rigging angle to be increased to twice the default value without the need to depress the release button.

As noted earlier, turns are executed by banking the board. In the basic version, the rider initiates a turn by shifting his weight laterally on the board toward what will be the inside of the intended turn to bank the board in that direction, then returns back to a centered position over the board to sustain a steady, coordinated turn. On approaching his intended new direction, he shifts his weight over to the outside of the turn to roll the board back to an upright position, then shifts his weight back over the center of the board as the craft rolls back up to halt the turn along the intended path. The low moment of inertia around the roll axis allows the rider to roll into, and out of a turn, very rapidly, which, when combined with the ability of the craft to generate large lift forces, can make it challenging for the rider to stop precisely at the desired bank angle, or exit a maneuver precisely on the desired course. Moreover, the craft becomes increasingly unstable and sensitive to errors in the bank angle as the bank angle increases. Thus a high level of skill is required to utilize the full maneuvering potential of the craft.

To facilitate more control in aggressive maneuvering, a preferred embodiment incorporates movable surfaces (21) into the lower trailing edge of the main struts as illustrated in FIG. 6. Their primary function is to increase the precision of rapid maneuvering, but they can also can be used to increase the rate of roll. Since they are behind the main struts, and both deflect in the same direction for a specific control input, they have some visual similarities to a pair of rudders—and they do cause the craft to turn. However, they cause the board to turn by generating a rolling moment to put the craft into a bank—like a pair of ailerons. Hence I refer to them as "rulerons".

When the ruleron control handle is moved away from its central (default) location, both rulerons deflect in the same direction, acting like flaps on a wing and generating a lateral force on each strut. This force generates moments about the both the roll and the yaw axes. However the angular accelerations about the two axes are entirely different in magnitude.

The typical surfer has substantially more mass than the craft, and his dimensions are comparable to, or exceed those of the craft. Therefore the principal axes for the moments of inertia of the craft for rotations about the roll and yaw axes are close to those axes for just the rider. For a prone rider, his moment of inertia about the yaw axis is between an order of magnitude, or greater, than his moment of inertia about the roll axis. At the same time, the moment arm for the lateral force generated by the rulerons for rotations about the roll axis is comparable with the length of the main struts, while the moment arm for rotations around the yaw axis is much smaller (e.g. ~20 percent of the moment arm about the roll axis) since the center of effort is only a short distance aft of the rider center-of-mass. Hence when the rulerons are deflected, the resulting angular accelerations about the roll axis will be between one and two orders of magnitude greater than the accelerations around the yaw axis. Thus the board will bank to turn, and there will be minimal resulting rotations around the yaw axis—contrary to the situation with a traditional rudder. For a kneeling rider, this decoupling between rotations around the roll axis and the yaw axis will be less since his moments of inertia about those axes become more comparable. However, there will still be substantial decoupling due to the differences in the moment arms about the two axes.

Figure 24:
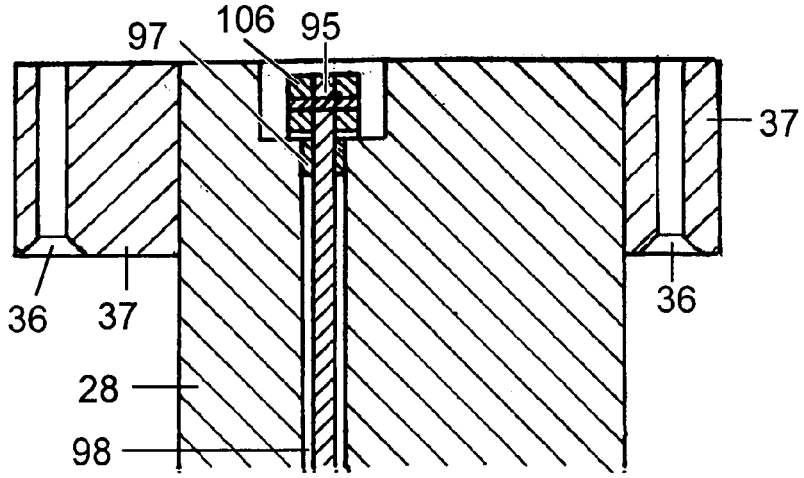
FIG. 24 is a cross-sectional view through the midplane of the main strut showing the details of the upper attachment block when a ruleron is incorporated into the strut.
Figure 25:
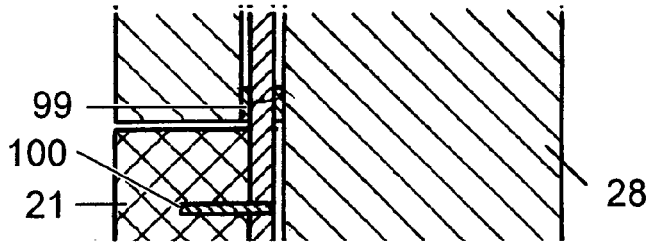
FIG. 25 is a cross-sectional view through the midplane of the main strut showing the details of the transition from a strut section to a strut plus ruleron section in the main strut assembly when a ruleron is present.
Figure 26:
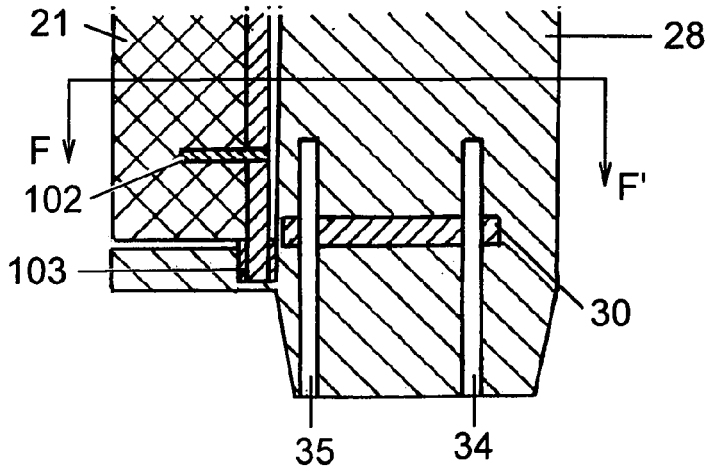
FIG. 26 is a cross-sectional view through the midplane of the main strut showing the termination of the ruleron control surface at the bottom of the strut when a ruleron is present in the main strut assembly.

The details of the of the main strut assembly (20) with the addition of a ruleron control surface (21) are illustrated in FIGS. 24–27. FIGS. 24–26 are cross-sectional views through the plane of symmetry of the foil and show the details at the upper end of the strut (FIG. 24); at the transition between the strut and a combination of strut and ruleron (FIG. 25), and at the bottom of the strut and ruleron (FIG. 26). The ruleron control surface (21) is bonded and pinned (100,102) to a torque rod (95). This rod runs a short distance down a cavity (98) below the ruleron and terminates in a bearing (103). The same cavity (98) extends up to the top of the strut (28) and attachment block (37). The rod also extends up this cavity, passing through a second bearing (99) just above the top of the ruleron before continuing up the remainder of the cavity and through a bearing (97) in the strut attachment block (37). After exiting the bearing it extends through, and is bonded and pinned to, a control arm (106) that can rotate within a relieved area of the attachment block. Hence rotations of the control arm result in rotations of the torque rod and of the ruleron control surface.

The lower end of the strut incorporating a ruleron mates and is secured to the main foil in exactly the same manner as the main strut assembly without a ruleron—a pair of machine screws from the main foil fittings run up a pair of holes (34,35) in the strut and screw into a nut-plate (30) embedded in the strut. The attachment block (37) mates with the same receptacle in the hull as the attachment block for a strut assembly without a ruleron, and the locations of the securing screws (36) are also the same.

Figure 27:
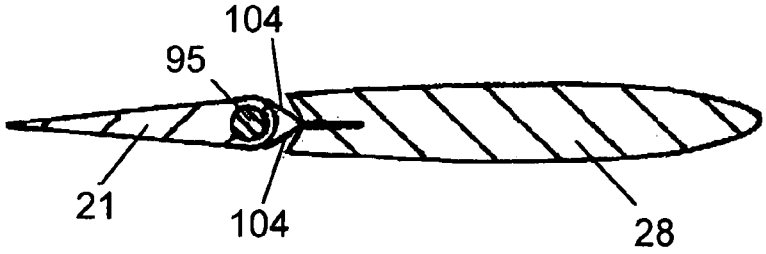
FIG. 27 is the cross-sectional view through section F_F' in FIG. 26 showing the gap seal between the ruleron control surface and the main strut.

If the ruleron is deflected, its effectiveness is sensitive to any leakage of water from the high pressure side of the strut foil to the low pressure side through any gap that may be present between the ruleron and the strut. FIG. 27, which is a cross-sectional view through section F_F' in FIG. 26, illustrates a means to seal this gap so as to maximize the ruleron effectiveness. The struts are constructed by building each side (28) in a mold, then inserting the torque rod (95) with attached ruleron (21) and bearings (97,99,103) into the cavity (98) in the two halves and bonding the two halves together. At the same time, two strips (104) of thin plastic sheet (e.g. polyester sheeting) are bonded between the two halves along the trailing edge of the strut where the ruleron is present. One strip splays out so that it lies on one side of the ruleron leading edge; the other strip does the same on the opposite side, so that in combination, they straddle the leading edge of the ruleron. The thickness and composition of these strips is chosen so that they are flexible enough to seal, yet stiff enough not to collapse under the pressure differential present between the two sides of the strut when the ruleron is deflected.

Figure 28:
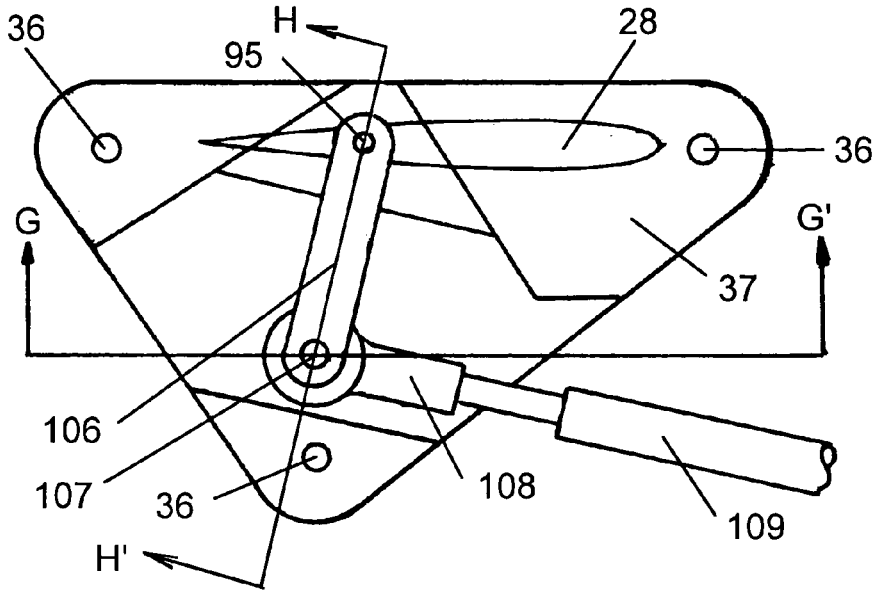
FIG. 28 is a top view of the main strut upper attachment block (when the strut assembly includes a ruleron control surface).
Figure 29:
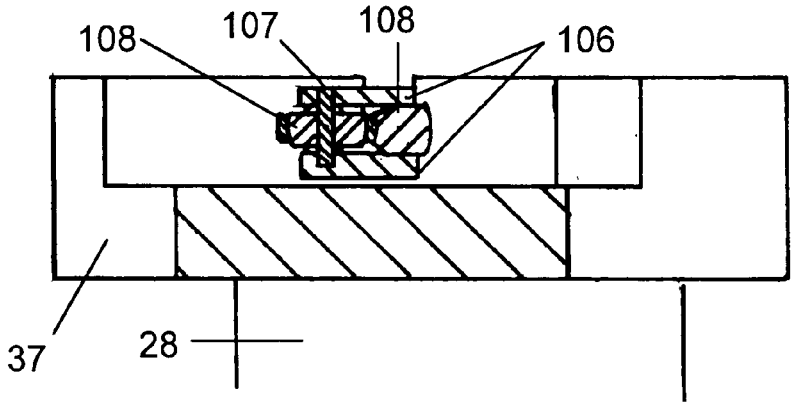
FIG. 29 is a sectional view through section G_G' in FIG. 28 showing the main strut attachment block (when the strut assembly includes a ruleron control surface).
Figure 30:
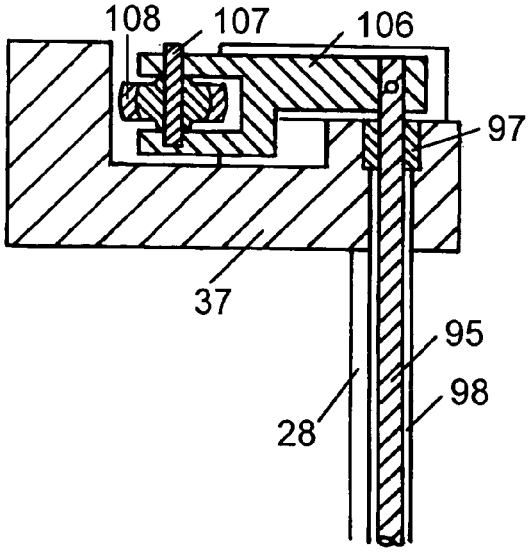
FIG. 30 is a cross-sectional view through section H_H' in FIG. 28 showing the main attachment block (when the strut assembly includes a ruleron control surface).

FIGS. 28, 29, and 30 illustrate the details of the control arm assembly incorporated into a recess in the upper side of the main strut attachment block. FIG. 29 is a cross-section view through section G_G' in FIG. 28; FIG. 30 is the cross-section view through section H_H'. To make room for the control arm (106) and the linkage (108, 109) leading forward to the control assembly (51) (see FIG. 17) near the bow of the craft, the upper strut attachment block (37) contains a pocket in the area between the three mounting holes (36). The push tube (109) and tie-rod end (108) move fore-and-aft in response to control inputs from the output arms (57) in the control assembly (51). These motions rotate the lever arm (106), the torque rod (95), and the ruleron (21) up to ±45 degrees relative to the no-deflection position. Hinge pin (107) is removable so that the control arm (106) can be separated from the tie-rod end (108) to allow the main strut assembly to be easily removed from the hull.

Figure 31:
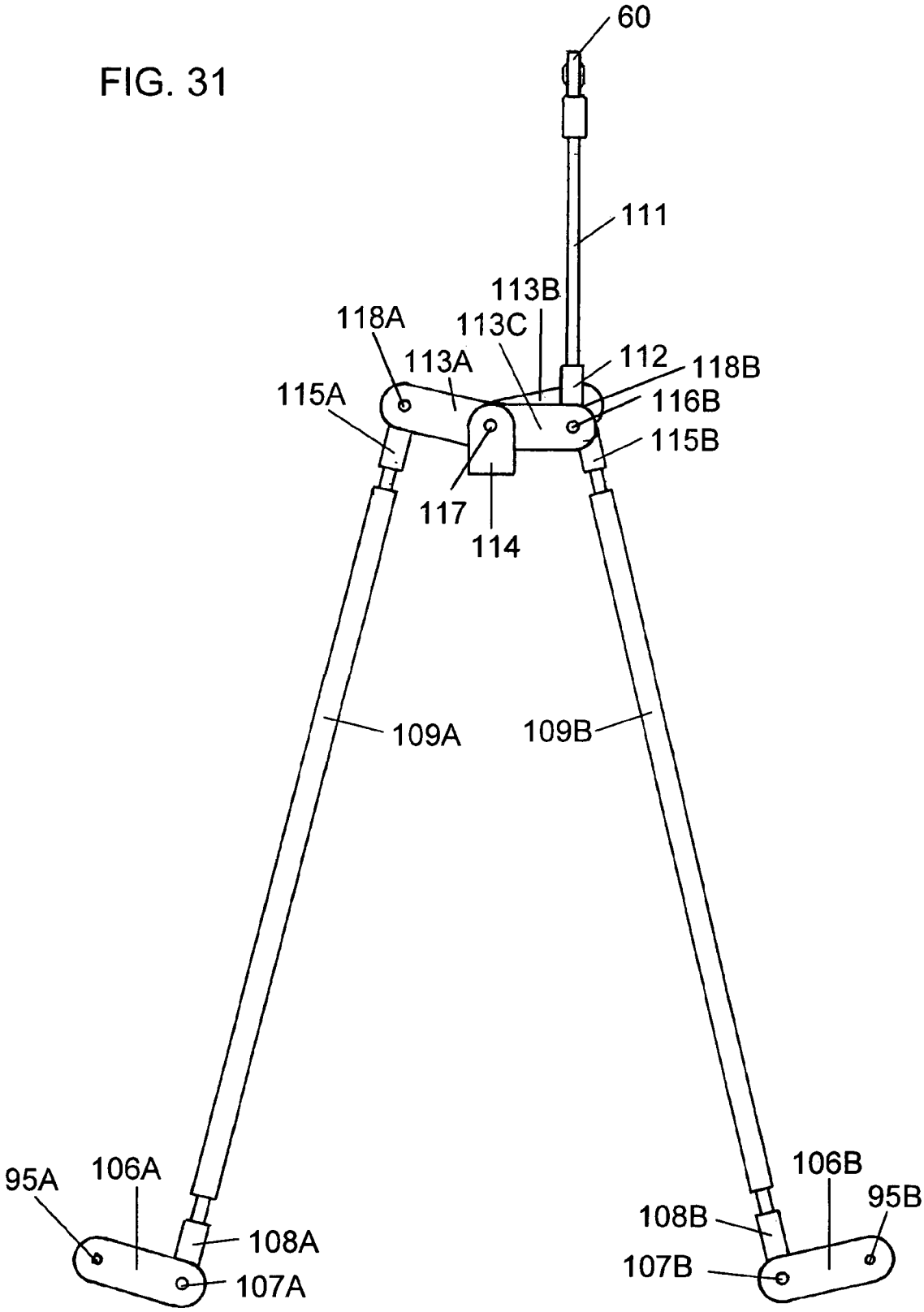
FIG. 31 is a top view of the control linkages between the flight control assembly and the control arms on the main strut attachment blocks (when the strut assemblies include a ruleron control surface).

The linkage between the ruleron control arms (57) in the control assembly (51) (FIG. 17) and the ruleron control arms (106) on the main strut attachment block (37) is illustrated in FIG. 31. Tie-rod end (60) is pinned to the ruleron control arms (57) at the control assembly. It connects to a tie-rod (111) that leads to a second tie-rod end (112) that terminates at hinge joint (116) at the bellcrank (113C). The bellcrank (113A,B,C) rotates around a pivot (117) in the bellcrank support (114), which is fastened to the hull. A tie-rod end (15A) for the left ruleron is pinned (118A) into another arm of the bellcrank (113A) and connects to a push-pull tube (109A) leading back to the tie-rod end (108A) that is pinned (107A) to the main strut attachment block control arm (106A). As described previously, the latter is bonded to the left torque rod (95A) and ultimately to the left ruleron. The right side ruleron control linkages (118B, 115B, 109B, 108B, 107B, 106B, 95B) running from the bellcrank (113B) aft, mirror those for the left ruleron.

I claim:

1. A non-powered wave riding watercraft adapted to support a surfer above a surface of water, the craft being controlled solely by the surfer in a prone or kneeling position, said craft being propelled solely by the efforts of the rider and by the force of gravity acting in conjunction with the sloping forward face of a progressive gravity wave, said craft comprising:

a low buoyancy hull, the hull having forward and rear ends and a longitudinal axis extending between the forward and rear ends;

a forward strut assembly mounted at substantially the forward end of the hull, the forward strut assembly comprising at least two forward struts positioned about the longitudinal axis of the hull and extending generally downwardly from a bottom of the hull;

at least one rear strut extending generally downwardly from the bottom of the hull;

a canard hydrofoil attached to the forward strut assembly and oriented transversely to the longitudinal axis of the hull, the canard hydrofoil having at least right-side and left-side foil segments;

a main hydrofoil attached to said at least one rear strut, the main hydrofoil extending transversely to the longitudinal axis of the hull and positioned below the bottom of the hull;

wherein the main hydrofoil is adapted to be submerged below the water surface and end segments of the canard foil are adapted to pierce the water surface when the craft is traversing across the face of a wave.

2. The wave riding craft of claim 1 wherein a hinge means is provided for flexibly attaching the front strut assembly to the hull in such a manner that the rigging angle of the canard hydrofoil may be adjusted among a plurality of rotational positions about a hinge axis substantially parallel to the pitch axis of the craft.

3. The wave riding craft of claim 2 wherein the hinge means comprises control means for moving the canard hydrofoil and the front strut assembly among a plurality of rotational positions.

4. The wave riding craft of claim 3 and comprising flap means mounted to said at least one rear strut.

5. The wave riding craft of claim 4 wherein the flap means comprises hinge means for flexibly attaching the flap means to said at least one rear strut in such a manner that the deflection angle of the flap means may be adjusted among a plurality of rotational positions about an axis substantially parallel to the yaw axis of the craft.

6. The wave riding craft of claim 5, wherein control means is provided for moving the flap means among a plurality of rotational positions.

7. The wave riding craft of claim 6 wherein the canard hydrofoil is undercambered.

8. The wave riding craft of claim 6 wherein the span of the canard hydrofoil is curved in the form of a parabolic arc and symmetrically disposed in the spanwise direction about the midspan position of the foil.

9. The wave riding craft of claim 8 wherein the canard hydrofoil is undercambered.

10. The wave riding craft of claim 3 wherein the canard hydrofoil is undercambered.

11. The wave riding craft of claim 3 wherein the span of the canard hydrofoil is curved in the form of a parabolic arc and symmetrically disposed in the spanwise direction about the midspan position of the foil.

12. The wave riding craft of claim 11 wherein the canard hydrofoil is undercambered.

13. The wave riding craft of claim 2 and comprising flap means mounted to said at least one rear strut.

14. The wave riding craft of claim 13 wherein the flap means comprises hinge means for flexibly attaching the flap means to the main support means in such a manner that the deflection angle of the flap means may be adjusted among a plurality of rotational positions about an axis substantially parallel to the yaw axis of the craft.

15. The wave riding craft of claim 14 wherein control means is provided for moving the flap means among a plurality of rotational positions.

16. The wave riding craft of claim 15 wherein the canard hydrofoil is undercambered.

17. The wave riding craft of claim 15 wherein the span of the canard hydrofoil is curved in the form of a parabolic arc and symmetrically disposed in the spanwise direction about the midspan position of the foil.

18. The wave riding craft of claim 17 wherein the canard hydrofoil is undercambered.

19. The wave riding craft of claim 2 wherein the span of the canard hydrofoil is curved in the form of a parabolic arc and symmetrically disposed in the spanwise direction about the midspan position of the foil.

20. The wave riding craft of claim 19 wherein the canard hydrofoil is undercambered.

21. The wave riding craft of claim 2 wherein the canard hydrofoil is undercambered.

* * * * *